US011185170B2

(12) United States Patent
Sherman et al.

(10) Patent No.: US 11,185,170 B2
(45) Date of Patent: Nov. 30, 2021

(54) MATTRESS WITH EMBEDDED TRANSDUCERS

(71) Applicant: PPJ, LLC, Natick, MA (US)

(72) Inventors: Philip Reid Sherman, Melville, NY (US); Horace Robert Eskridge, III, Lexington, KY (US); Philip Woods McCarty, Natick, MA (US)

(73) Assignee: PPJ, LLC, Natick, MA (US)

( * ) Notice: Subject to any disclaimer, the term of this patent is extended or adjusted under 35 U.S.C. 154(b) by 76 days.

(21) Appl. No.: 16/591,075

(22) Filed: Oct. 2, 2019

(65) Prior Publication Data

US 2020/0107646 A1 Apr. 9, 2020

Related U.S. Application Data

(60) Provisional application No. 62/740,722, filed on Oct. 3, 2018.

(51) Int. Cl.

| | |
|---|---|
| ***H04R 1/00*** | (2006.01) |
| ***A47C 21/00*** | (2006.01) |
| ***H04R 3/04*** | (2006.01) |
| ***H04R 1/02*** | (2006.01) |

(52) U.S. Cl.

CPC ..... *A47C 21/006* (2013.01); *A47C 21/003* (2013.01); *H04R 1/025* (2013.01); *H04R 3/04* (2013.01); *H04R 2400/03* (2013.01)

(58) Field of Classification Search

CPC .... A47C 21/003; A47C 21/006; H04R 1/025; H04R 1/026; H04R 1/26; H04R 1/028; H04R 3/04; H04R 2400/03; H04R 2205/026; H04R 5/023

See application file for complete search history.

(56) References Cited

U.S. PATENT DOCUMENTS

| | | | |
|---|---|---|---|
| 4,020,299 | A | 4/1977 | Garner et al. |
| 5,624,155 | A | 4/1997 | Bluen et al. |
| 6,377,145 | B1 | 4/2002 | Kumagai |
| 7,418,108 | B2 | 8/2008 | Oser |
| 7,553,288 | B2 | 6/2009 | Cohen |
| 7,981,064 | B2 | 7/2011 | Oser et al. |
| 8,077,884 | B2 | 12/2011 | Oser et al. |
| 8,617,089 | B2 | 12/2013 | Oser et al. |

(Continued)

FOREIGN PATENT DOCUMENTS

| | | | |
|---|---|---|---|
| CN | 204862190 | U * | 12/2015 |
| EP | 1925184 | A2 | 5/2008 |

(Continued)

OTHER PUBLICATIONS

Perry, "Customatic debuts pulsing VibraSense mattress, Room Caddie," FurnitureToday, Jul. 31, 2017, https://www.furnituretoday.com/business-news/customatic-debuts-pusling-vibrasense-mattress/.

*Primary Examiner* — Matthew A Eason
(74) *Attorney, Agent, or Firm* — Patent Portfolio Builders PLLC

(57) ABSTRACT

Furniture such as a mattresses and beds containing mattresses include transducers disposed within the furniture and exposed from external surfaces of the furniture to deliver sounds or ranges of sonic frequencies in a sonic wave vibration format through the furniture to the occupant of the furniture and audible format through external speakers to an area around the furniture.

20 Claims, 19 Drawing Sheets

(56) References Cited

U.S. PATENT DOCUMENTS

| | | | | |
|---|---|---|---|---|
| 8,761,417 | B2 | 6/2014 | Oser et al. | |
| 2005/0207609 | A1 | 9/2005 | Oser | |
| 2007/0025575 | A1* | 2/2007 | Oser ..... | H04R 9/066<br>381/333 |
| 2007/0041606 | A1 | 2/2007 | Sheppard | |
| 2009/0010468 | A1 | 1/2009 | Oser et al. | |
| 2011/0257468 | A1 | 10/2011 | Oser et al. | |
| 2012/0313765 | A1 | 12/2012 | Oser et al. | |
| 2014/0114120 | A1 | 4/2014 | Oser et al. | |

FOREIGN PATENT DOCUMENTS

| | | | |
|---|---|---|---|
| EP | 1925184 | A4 | 11/2009 |
| WO | 2006091205 | A1 | 8/2006 |
| WO | 2007019580 | A2 | 2/2007 |
| WO | 2007019580 | A3 | 2/2007 |

* cited by examiner

| | # | Component Name | Dimensions | | | | Density (lbs) | Tolerance | Mattress Foam Structure |
|---|---|---|---|---|---|---|---|---|---|
| | | | L | W | H | Cut-out Holes | | | |
| 12" TX | 1 | | 80" | 38" | 12" | | | Foam thickness tolerance:±1/4": Density tolerance: Inner & Outer Cover tolerance: ±1/4" | 1.5" Plush Memory Foam<br>2.5" Perforated Memory Foam<br>1" Supportive Poly Base Foam w/subwoofer cuts<br>7" Support Base Foam |
| | 2 | Supportive Poly Base Foam | 79" | 37" | 1" | ø11cm x 3subs | 1.56 | | |
| | 3 | Supportive Poly Base Foam | 79" | 37" | 7" | / | 1.56 | | |
| | 4 | Plush Memory Foam | 79" | 37" | 1.5" | / | 3.00 | | |
| | 5 | Memory Foam | 79" | 37" | 2.5" | / | 3.00 | | |
| | 6 | Outer Cover | 80" | 38" | 12" | / | | | |
| | 7 | Mesh Fabric on Outer Cover | / | / | 7.25" | / | | | |
| | 8 | Circular Knit Outer Cover | / | / | 4.25" | / | | | |
| | 9 | Zipper on Outer Cover | / | / | 0.5" | / | | | |
| | 10 | Inner Cover | 81" | 39" | 13" | / | | | |

| | # | Component Name | Dimensions | | | | Density (lbs) | Tolerance | Mattress Foam Structure |
|---|---|---|---|---|---|---|---|---|---|
| | | | L | W | H | Cut-out Holes | | | |
| 12" QN | 1 | | 80" | 60" | 12" | | | Foam thickness tolerance:±1/4": Density tolerance: Inner & Outer Cover tolerance: ±1/4" | 1.5" Plush Memory Foam<br>2.5" Perforated Memory Foam<br>1" Supportive Poly Base Foam w/subwoofer cuts<br>7" Support Base Foam |
| | 2 | Supportive Poly Base Foam | 79" | 59" | 1" | ø11cm x 6subs | 1.56 | | |
| | 3 | Supportive Poly Base Foam | 79" | 59" | 7" | / | 1.56 | | |
| | 4 | Plush Memory Foam | 79" | 59" | 1.5" | / | 3.00 | | |
| | 5 | Memory Foam | 79" | 59" | 2.5" | / | 3.00 | | |
| | 6 | Outer Cover | 80" | 60" | 12" | / | | | |
| | 7 | Mesh Fabric on Outer Cover | / | / | 7.25" | / | | | |
| | 8 | Circular Knit Outer Cover | / | / | 4.25" | / | | | |
| | 9 | Zipper on Outer Cover | / | / | 0.5" | / | | | |
| | 10 | Inner Cover | 81" | 61" | 13" | / | | | |

| | # | Component Name | Dimensions | | | | Density (lbs) | Tolerance | Mattress Foam Structure |
|---|---|---|---|---|---|---|---|---|---|
| | | | L | W | H | Cut-out Holes | | | |
| 12" KG | 1 | | 80" | 76" | 12" | | | Foam thickness tolerance:±1/4": Density tolerance: Inner & Outer Cover tolerance: ±1/4" | 1.5" Plush Memory Foam<br>2.5" Perforated Memory Foam<br>1" Supportive Poly Base Foam w/subwoofer cuts (see right >)<br>7" Support Base Foam |
| | 2 | Supportive Poly Base Foam | 79" | 75" | 1" | ø11cm x 6subs | 1.56 | | |
| | 3 | Supportive Poly Base Foam | 79" | 75" | 7" | / | 1.56 | | |
| | 4 | Plush Memory Foam | 79" | 75" | 1.5" | / | 3.00 | | |
| | 5 | Memory Foam | 79" | 75" | 2.5" | / | 3.00 | | |
| | 6 | Outer Cover | 80" | 76" | 12" | / | | | |
| | 7 | Mesh Fabric on Outer Cover | / | / | 7.25" | / | | | |
| | 8 | Circular Knit Outer Cover | / | / | 4.25" | / | | | |
| | 9 | Zipper on Outer Cover | / | / | 0.5" | / | | | |
| | 10 | Inner Cover | 81" | 77" | 13" | / | | | |

*Fig. 9*

853 854 851 850 855

| | | Male | | | | | | Female | | | | | |
|---|---|---|---|---|---|---|---|---|---|---|---|---|---|
| | | 5th % M | 5th % In | 50th % M | 50th % In | 95th % M | 95th % In | 5th % M | 5th % In | 50th % M | 50th % In | 95th % M | 95th % In |
| | Body Segment | | | | | | | | | | | | |
| Stature | A | 1.649 | 65 | 1.759 | 69 | 1.869 | 74 | 1.518 | 60 | 1.618 | 64 | 1.724 | 68 |
| Eye height (standing) | B | 1.545 | 61 | 1.644 | 65 | 1.748 | 69 | 1.427 | 56 | 1.52 | 60 | 1.63 | 64 |
| Mid shoulder height | C | 1.346 | 53 | 1.44 | 57 | 1.564 | 62 | 1.21 | 48 | 1.314 | 52 | 1.441 | 57 |
| Waist height | D | 0.993 | 39 | 1.102 | 43 | 1.168 | 46 | 0.907 | 36 | 0.985 | 39 | 1.107 | 44 |
| Buttocks height | E | 0.761 | 30 | 0.839 | 33 | 0.919 | 36 | 0.691 | 27 | 0.742 | 29 | 0.832 | 33 |
| Sitting height | F | 0.859 | 34 | 0.927 | 37 | 0.975 | 38 | 0.797 | 31 | 0.853 | 34 | 0.911 | 36 |

852 856 857

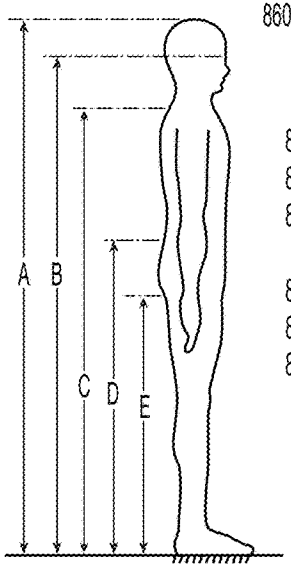

860 868 869

| | Zone Location - assumes 3" top of head - Stature (A) top of mattress: | | | | |
|---|---|---|---|---|---|
| | | Male | | Female | |
| | | 95th % M | 5th % M | 95th % M | 5th % M |
| 865 | A | 74 | 65 | 68 | 60 |
| 866 | C | 62 | 53 | 57 | 48 |
| 867 | E | 36 | 30 | 33 | 27 |
| | | | | | |
| 862 | To shoulders | 15 | 15 | 14 | 15 |
| 863 | To lower buttocks | 26 | 23 | 24 | 21 |
| 864 | Top to lower buttocks | 41 | 38 | 38 | 36 |
| | | | | | |

A: Stature
B: Eye height (standing)
C: Mid shoulder height
D: waist height
E: Buttocks height

*Fig. 10*

MATTRESS WITH EMBEDDED TRANSDUCERS

CROSS-REFERENCE TO RELATED APPLICATIONS

This application claims priority to U.S. Provisional Patent Application No. 62/740,722, filed Oct. 3, 2018, the entire contents of which are incorporated herein by reference.

TECHNICAL FIELD

Embodiments of the subject matter disclosed herein relate to mattresses and other body support surfaces.

BACKGROUND

Sound and sonic frequencies can be integrated into chairs, couches and beds. This includes the incorporation of speakers to deliver audible sounds, e.g., music, to the occupants of the chairs, couches and beds. In addition, transducers can be used to deliver sonic frequencies or vibrations to the occupant of the chairs, couches and beds.

SUMMARY

Embodiments are directed to the incorporation of transducers into furniture including the framing and the support surfaces contained in the furniture. The support surfaces include cushioned and multilayer support surfaces, and the furniture include chairs, couches and beds. The transducers include external transducers configured and positioned to deliver sounds, sonic waves and sonic signals outward from the furniture, external transducers configured and positioned to deliver sounds, sonic waves and sonic signals outward from the support surface of the furniture, internal transducers configured and positioned to deliver sounds, sonic waves and sonic signals through the support surface of the furniture or toward the occupant of the furniture and combinations thereof.

In one embodiment, sounds, sonic waves or sonic signals to be delivered to the transducers are parsed by frequency into a plurality of frequencies, frequency ranges or frequency bands. In one embodiment, the sounds or sonic signals are parsed by setting a crossover to parse a single sound or sonic signal into two or three output signals, each having a separate frequency band. The frequency bands in the output signals range from low frequencies to high frequencies.

Each transducer can receive the same sound or sonic frequencies. Alternatively, each transducer receives a distinct sound or sonic frequency. In one embodiment, different frequencies or frequency ranges are delivered to individual transducers based on the location of the transducers within the furniture. In one embodiment, higher frequency sounds are delivered to transducers or speakers delivering sounds through the air toward the occupant of the furniture and in particular toward the head of the occupant for purposes of listening to those sounds. These transducers can be referred to as tweeters. The lower frequency portions of the sound are delivered to transducers that deliver the sounds to the occupant through the furniture or support surface. These transducers can be referred to as woofers or subwoofers. In one embodiment, the occupant of the furniture is provided with a given sound or sonic signal, e.g., music, a soundtrack or gaming environment sounds, divided into a plurality of frequencies bands that are delivered to different transducers for simultaneous delivery to the occupant. Therefore, the given sound or sonic signal is delivered to the occupant through the air in an audible format, e.g., high end frequencies, and through the furniture in a tactile format, e.g., low end frequencies. Delivery of sounds or sonic frequencies in audible and tactile formats creates a more immersive experience in which the occupant of the furniture hears the sounds and feels the experience of being in the concert, movie, television show or computer game. Therefore, furniture containing the transducers can be used for viewing or participating in video gaming in addition to viewing movies, television programs, sporting events and musical concerts.

In addition to providing sounds associated with an event being viewed or a computer-based game that is being played, the furniture, for example, beds, is used to deliver audible sounds, tactile frequencies or both audible sounds and tactile frequencies selected and controlled to solicit a beneficial, therapeutic or physiological response in the occupant of the furniture. In one embodiment, the transducers are used to deliver sleep sounds adjacent to the head of the occupant in combination with associated soothing tactile sensations delivered through a mattress for enhanced rest.

In one embodiment, the transducers in a plurality of transducers are located in the furniture or support surface of the furniture. The transducers are located in accordance with the portion of the occupant to receive the desired sounds, tactile sensations or vibrations. To deliver audible sounds, external transducers or speakers are placed adjacent the head of the occupant of the furniture and communicate those audible sounds through the air to the occupant. Additional internal transducers that deliver lower frequencies, e.g., subwoofers, are located within the furniture in locations that align with given body portions of the occupant. These body portions include, for example, the neck, torso, arms, hands, legs and feet. In one embodiment, the internal transducers are located within the furniture in accordance with census data and body profiles to accommodate and to align with the largest number of individuals or largest percentage of the population.

In one embodiment, each transducer is configured to be easily replaceable and serviceable. In one embodiment, the plurality of transducers includes two transducers positioned to provide audible sounds externally to or outwardly from the furniture or support surface, e.g., two external speakers for high end audio. In addition, two or more transducers are provided internal to the furniture or support surface to deliver low end tactile sensations or vibrations through the support surface to the occupant. In one embodiment, the low-end internal transducers are two internal subwoofers. In one embodiment, the lower frequency range internal transducers or subwoofers are operable independent of the higher frequency range transducers. Therefore, the low frequency range transducers operate as an independent massage system. The independent massage system can deliver tactile sensations or vibrations in a variety of wave modes. In one embodiment, each external transducer or speaker and each internal transducer is controllable independent of any other transducer.

In one embodiment, the furniture containing the plurality of transducers includes a control system in communication with the transducers. The control system controls the transducers, parses the sounds or sonic signals into independent frequencies or frequencies bands and delivers the sounds or sonic frequencies to individual transducers. Communication with each transducer can be through a wired or wireless connection. In one embodiment, the control system is provided as firmware configured to manage the parsing and delivery of the sounds and thermal characteristics of a continuous mode of operation. The firmware is incorporated into the furniture and is in communication with a suitable source of power. The furniture containing the plurality of transducers and the control system including the firmware includes a plurality of wired and wireless inputs and outputs used to communicate with the control system including providing or downloading sounds or sonic signals, downloading firmware updates and communicating commands from the occupant of the furniture. Suitable inputs and outputs include BlueTooth, Audio Line Inputs, Auxiliary Inputs, coaxial cable connections, SD card interfaces and standard audio input jacks.

Exemplary embodiments are also directed to the furniture and support surface containing the incorporated transducers and to methods of controlling and operating the incorporated transducers.

Exemplary embodiments are directed to furniture for delivering audible and tactile sensations to an occupant. In one embodiment, the furniture is a mattress or includes a mattress. The furniture includes a top surface for supporting the occupant, a bottom surface opposite the top surface, a head end surface spanning from the top surface to the bottom surface, a foot end surface spanning from the top surface to the bottom surface and two opposing side surfaces spanning from the top surface to the bottom surface. Each opposing side surface extends from the head end to the foot end.

The furniture includes at least one internal transducer disposed in the furniture between the top surface and the bottom surface to communicate sonic frequencies through the furniture to the top surface. In one embodiment, each internal transducer is spaced from the head end surface, the foot end surface and the two opposing side surfaces. In one embodiment, the furniture includes a plurality of internal transducers. Each internal transducer is positioned to communicate sonic frequencies to a given location on the occupant. In one embodiment, the furniture includes a plurality of internal transducers, and each transducer is located in one of a plurality of distinct zones extending along a length of the mattress from the head end surface to the foot end surface. Each zone extends partially along the length and corresponds to a given body portion of the occupant. In one embodiment, the distinct zones align with given body portions of a desired percentage of a population of occupants. In one embodiment, the desired percentage is at least ninety five percent.

The furniture includes at least one external transducer positioned to communicate sonic frequencies externally to the top surface. In one embodiment, external transducer is disposed in the mattress and extends through the head end surface or one of the opposing side surfaces to communicate sonic frequencies outward or externally from the head end surface or outward or externally from one of the opposing side surfaces adjacent the head end surface. In one embodiment, the furniture also includes a foundation having a support surface and a plurality of vertical sides extending down from the support surface. The mattress is disposed on the support surface, and each external transducer is disposed in the foundation and extends through one of the vertical sides to communicate sonic frequencies outward from the vertical sides.

The furniture includes a control system in communication with each internal transducer and each external transducer. The control system receives a given sonic signal and filters the given sonic signal into at least two sonic frequency bands. The control system communicates higher sonic frequency bands to the external transducers and communicates lower sonic frequency bands to the internal transducers. In one embodiment, the control system includes a crossover circuit to filter the given sonic signal into the sonic frequency bands. In one embodiment, the control system filters the sonic signal into two frequency bands, a low sonic frequency band and a high sonic frequency band. In one embodiment, the low sonic frequency band includes frequencies less than 2000 Hz, and the high sonic frequency band includes frequencies greater than 2000 Hz. In one embodiment, the low sonic frequency band contains frequencies from about 20 Hz to about 200 Hz, and the high sonic frequency band contains frequencies from about 2000 Hz to about 20,000 Hz. In one embodiment, the control system filters the sonic signal into three frequency bands, a low sonic frequency band, a middle sonic frequency band and a high sonic frequency band. At least one of the low sonic frequency band and the middle sonic frequency band are communicated to internal transducers.

Exemplary embodiments are also directed to furniture for delivering audible and tactile sensations to an occupant. The furniture is or includes a mattress having a top surface for supporting the occupant, a bottom surface opposite the top surface, a head end surface spanning from the top surface to the bottom surface, a foot end surface spanning from the top surface to the bottom surface and two opposing side surfaces spanning from the top surface to the bottom surface. Each opposing side surface extends from the head end to the foot end.

At least one internal transducer is disposed in the furniture between the top surface and the bottom surface and is spaced from the head end surface, the foot end surface and the two opposing side surfaces to communicate sonic frequencies through the furniture to the top surface. In one embodiment, the furniture includes a plurality of internal transducers. Each internal transducer is located in one of a plurality of distinct zones extending along a length of the mattress from the head end surface to the foot end surface. Each zone extends partially along the length and corresponds to a given body portion of the occupant. The distinct zones align with given body portions of at least ninety five percent of a population of occupants.

The furniture includes at least one external transducer positioned to communicate sonic frequencies externally to the top surface adjacent the head end surface. In one embodiment, each external transducer is disposed in the mattress and extends through the head end surface or one of the opposing side surfaces to communicate sonic frequencies outward from the head end surface or outward from one of the opposing side surfaces. In one embodiment, the furniture also includes a foundation having a support surface and a plurality of vertical sides extending down from the support surface. The mattress is disposed on the support surface, and each external transducer is disposed in the foundation and extends through one of the vertical sides to communicate sonic frequencies outward from the vertical sides adjacent the head end surface.

The furniture includes a control system in communication with each internal transducer and each external transducer. The control system is configured to receive a given sonic signal, to filter the given sonic signal into a low sonic frequency band and a high sonic frequency band, to communicate the high sonic frequency band to the external transducers and to communicate the low sonic frequency band to the internal transducers. In one embodiment, the low sonic frequency band and the high sonic frequency band are distinct sonic frequency bands. In one embodiment, the low sonic frequency band contains frequencies less than 2000

Hz, and the high sonic frequency band includes frequencies greater than 2000 Hz. In one embodiment, the low sonic frequency band contains frequencies from about 20 Hz to about 200 Hz, and the high sonic frequency band contains frequencies from about 2000 Hz to about 20,000 Hz.

BRIEF DESCRIPTION OF THE DRAWINGS

The accompanying drawings, which are incorporated in and constitute a part of the specification, illustrate one or more embodiments and, together with the description, explain these embodiments. In the drawings:

FIG. 9 is a chart providing dimensional information and configurations for embodiments of a mattress containing cut-out holes for embedded transducers;

FIG. 10 is an anthropometric chart showing the anthropometric measurement for both male and female humans;

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Exemplary embodiments are directed to furniture or furnishings containing a plurality of transducers to deliver audible sounds, sonic frequencies and vibrations to users or occupants of the furniture. Suitable furniture or furnishings include, but are not limited to, chairs, gaming chairs, desk chairs, car seats, bus seats, airplane seats, theater seats, lounges, couches, massage tables, mattresses, pillows, beds, adjustable beds and hospital beds. The transducers can be incorporated into or attached to one or more of the structures, framing and support surfaces of the furniture. The support surfaces contact and provide support to one or more portions of the user or occupant of the furniture. In one embodiment, the support surfaces are padded and upholstered support surfaces. Suitable support surfaces include cushioned and multilayer support surfaces including, for example, seats and armrests.

Figure 1:
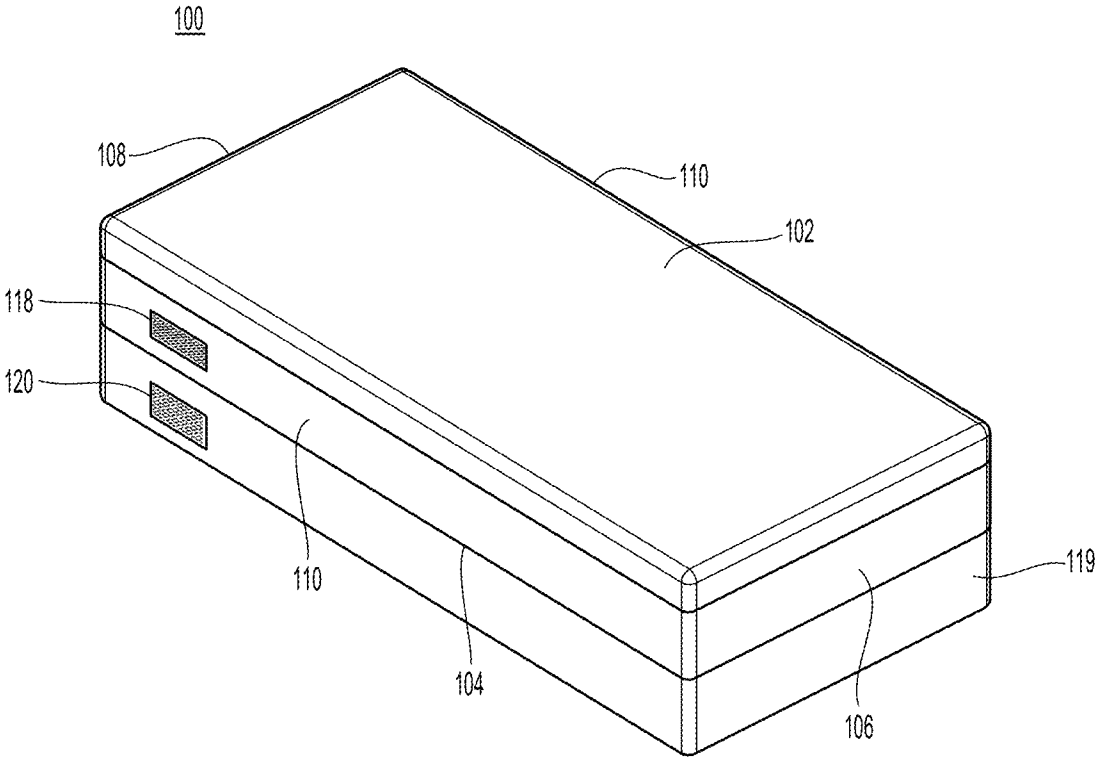
FIG. 1 is a top perspective view of an embodiment of a mattress containing embedded transducers in accordance with the present invention.
Figure 2:
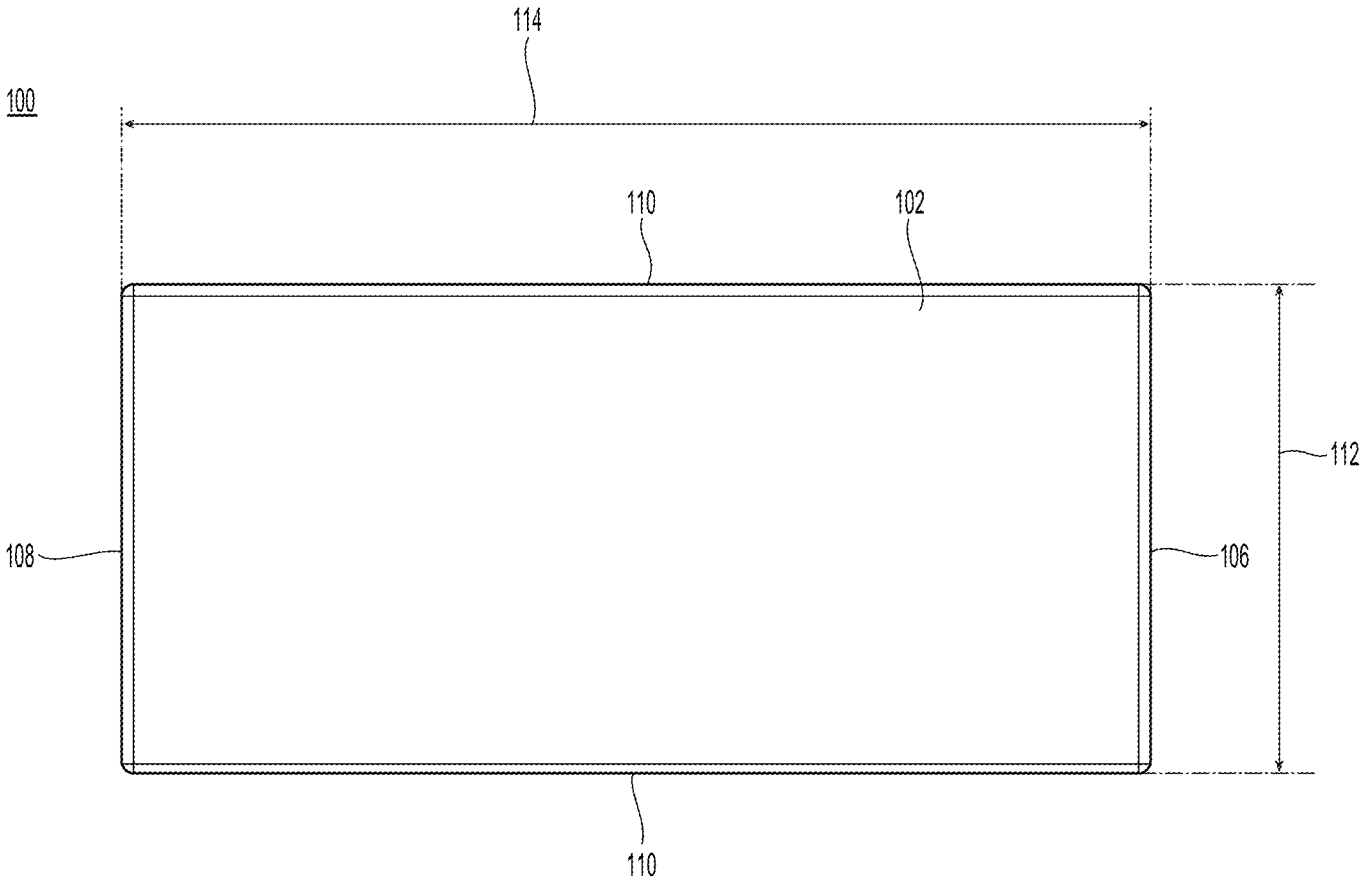
FIG. 2 is a top view of the mattress.
Figure 3:
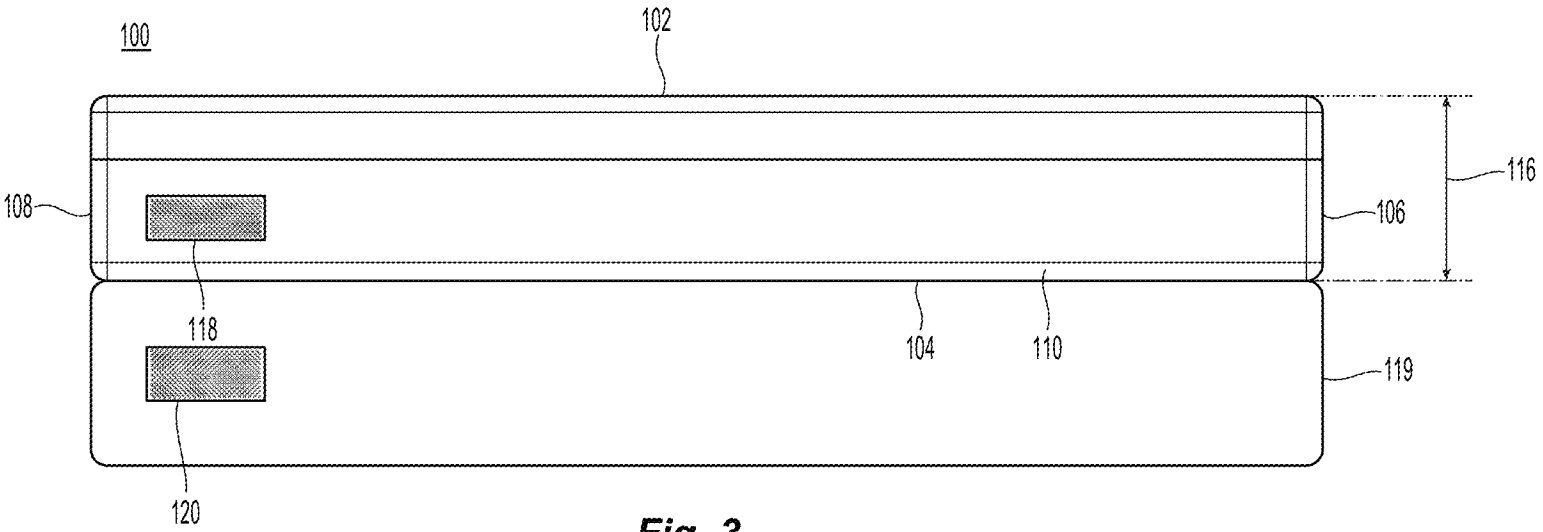
FIG. 3 is a side view of the mattress.

Referring initially to FIGS. 1-3, in one embodiment the furniture or furnishing includes a mattress 100. While illustrated as a mattress, the transducers, arrangements of transducers, control systems operating the transducers and operation of transducers described herein can be incorporated into any type of furniture. In one embodiment, the mattress is a stand-alone mattress that can be used with any suitable type of fixed or adjustable bed frame or foundation. Alternatively, the mattress is attached to or incorporated into a fixed or adjustable bed frame. In one embodiment, the mattress includes all transducers and control electronics to deliver the audible sounds, sonic frequencies and vibrations to the occupants of the mattress. In one embodiment, the transducers and control electronics are incorporated into and divided between the mattress and the foundation supporting the mattress.

The mattress 100 includes a top surface 102, which is the contact surface for supporting one or more occupants, and a bottom surface 104 opposite the top surface. In one embodiment, the bottom surface is the surface that contacts the frame or foundation 119 upon which the mattress is positioned. In one embodiment, the mattress is a two-sided mattress, i.e., either the top surface of the bottom surface can be positioned as the occupant contact surface. The mattress includes a head end 108 having a head end surface spanning from the top surface to the bottom surface and a foot end 106 opposite the head end and having a foot end surface spanning from the top surface to the bottom surface. The mattress also includes a pair of opposing sides 110 having two opposing side surfaces, each spanning from the top surface to the bottom surface and extending from the head end to the foot end.

The furniture includes at least one internal transducer and at least one external transducer. In one embodiment, the furniture includes a plurality of internal transducers. Each internal transducer is located internally to the furniture, i.e., between the top surface and the bottom surface and delivers a given band of sonic frequencies or vibrations internally through the furniture to the support surface. In one embodiment for a mattress, each internal transducer is spaced from the head end surface, the foot end surface and the two opposing side surfaces. In one embodiment, the transducers are arranged symmetrically with respect to the head end and foot end, the pair of opposing sides or both the head end and foot end and the pair of opposing sides. Alternatively, the transducers in the plurality of transducers are positioned in accordance with one or two occupants lying on the mattress with their head adjacent the head end of the mattress and their feet adjacent the foot end of the mattress.

The mattress has a width 112 extending between the pair of opposing sides and a length 114 extending between the head end and the foot end. In one embodiment, the width is 38" and the length is 80". In one embodiment, the width is 60" and the length is 80". In one embodiment, the width is 76" and the length is 80". Overall, any suitable size of mattress can be accommodated, e.g., twin, full, queen, king and California king or custom sized mattresses. In one embodiment, the mattress has a thickness 116 between the top surface and the bottom surface of about 12 inches.

In one embodiment, the furniture includes at least one external transducer or speaker positioned to communicate or to deliver sounds, audible sonic frequencies or sonic frequency bands externally from the furniture toward the top surface and in particular to the head end of the top surface. In one embodiment, two external speakers or transducers are provided. When the furniture is a mattress, a given external transducer can be located external to the mattress but integrated into other portions of the furniture, for example, the base or foundation for the mattress. In one embodiment, a given external transducer is located external to or independent of the furniture. Each external transducer delivers a given band of sonic frequencies externally or outward from the furniture. Therefore, each external transducer delivers the sonic frequencies or sonic frequency bands delivered to that transducer through the air. For example, high end frequencies are delivered through the external transducers or speakers.

In one embodiment, one or more external transducers 118 or speakers are visible or are exposed on an exterior surface of the mattress. For example, transducers producing audible sounds or audio are exposed on the opposing side surfaces of the mattress adjacent the head end or on the head end surface. Therefore, audible sounds are delivered to the head of the person occupying the mattress without having to pass through the mattress. In one embodiment, one or more external transducers 120 are exposed on vertical surfaces extending down from the support surface of the base or foundation 119 supporting the mattress. These vertical surfaces and the location of the transducers in the vertical surfaces correspond are adjacent the head end or head end surfaces of the mattress. In one embodiment, one or more transducers generating the audible sounds, sonic frequencies and vibrations are mounted to the mattress, are exposed from a side surface of the mattress and are covered by an outer cloth covering over the mattress. Therefore, the transducers are not visible on the exterior of the mattress. In one embodiment, the external transducers are positioned completely external to the furniture, for example, external to the mattress and the mattress frame or foundation. These external transducers can be positioned on the floor, on the wall or on, for example, tables adjacent the furniture. The external transducers or external speakers are in communication with, are controlled by and received the desired sounds, audible frequencies or sonic frequencies from the control system of the furniture. This control system is also in communication with the internal transducers.

Figure 4:
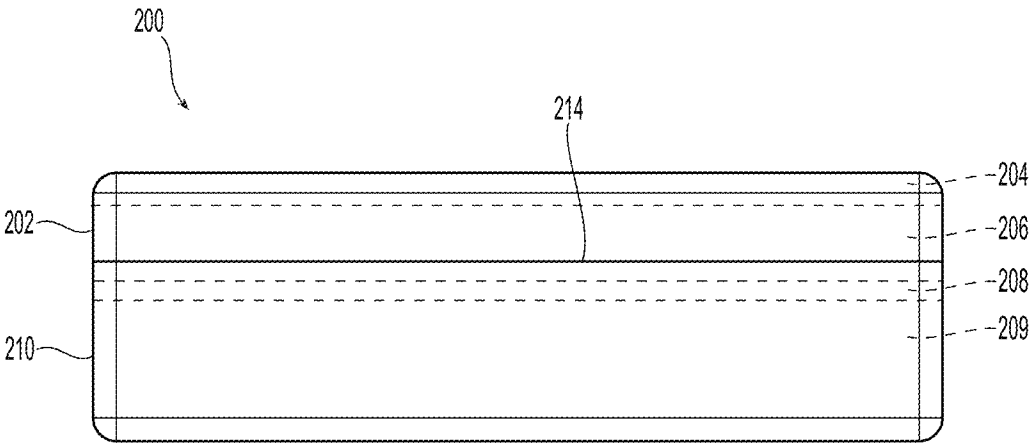
FIG. 4 is a hidden line end view of an embodiment of a multilayered mattress having cut-out holes for transducers.
Figure 6:
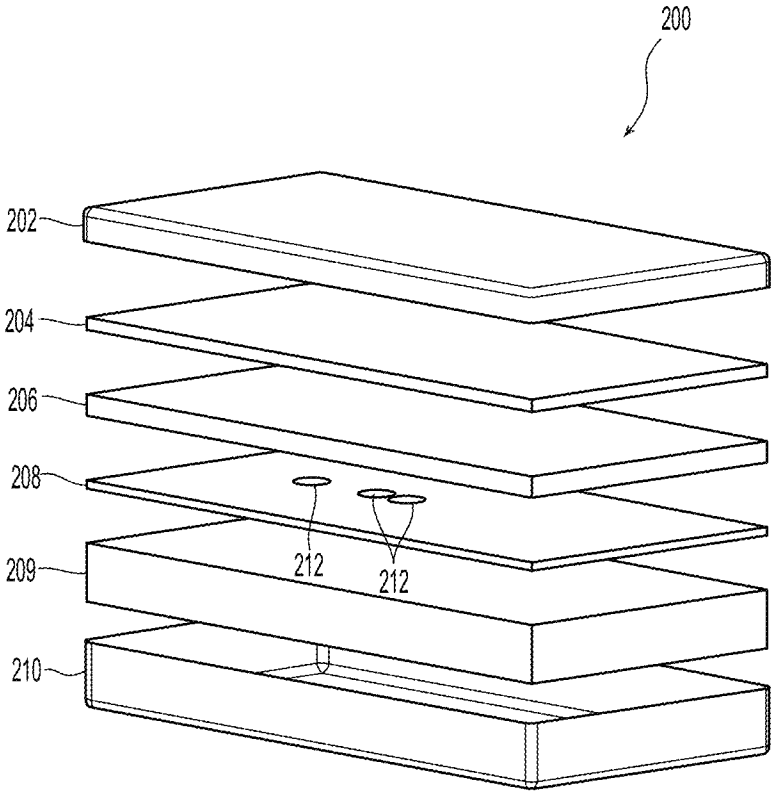
FIG. 6 is an exploded perspective view of an embodiment of a multilayered mattress having cut-out holes for transducers.
Figure 5:
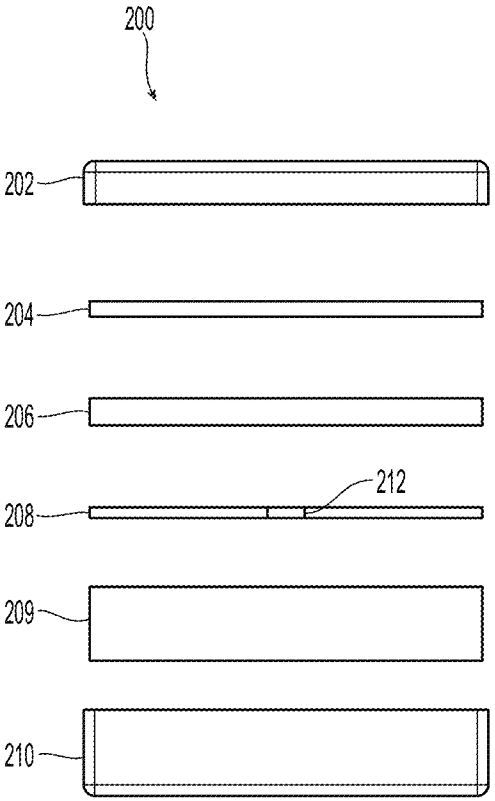
FIG. 5 is an exploded elevation view from an end of an embodiment of a multilayered mattress having cut-out holes for transducers.

In one embodiment, the mattress is constructed from a single layer of material, for example, a single layer of foam. Alternatively, the mattress includes a plurality of separate layers of material. Suitable materials include foam materials, cloth materials and springs. Referring now to FIGS. 4-6, an embodiment of furniture containing a mattress 200 having a plurality of separate layers is illustrated. As illustrated the mattress includes four separate layers covered by a two-part cover. The mattress can include more than 4 layers or less than 4 layers. The layers, from the top surface to the bottom surface, include a top plush memory foam layer 204, a memory foam layer 206 positioned under the plush memory foam layer, a first supportive poly base foam layer 208 positioned under the memory foam layer and a second supportive poly base foam layer 209 positioned under the first supportive poly base foam layer. Any suitable foams for the foam layers that are known and available in the art can be used.

In one embodiment, the plush memory foam layer has a thickness of up to about 1.5 inches and a density of up to about 3 lbs. In one embodiment, the memory foam layer has a thickness of up to about 2.5 inches and a density of up to about 3 lbs. In one embodiment, the first supportive poly base foam layer has a thickness of up to about 1 inch and a density of up to about 1.56 lbs. In one embodiment, the second supportive poly base foam layer has a thickness of up to about 7 inches and a density of up to about 3 lbs. In one embodiment, the foam layers are encased in a top outer cover 202 placed over the top in combination with a bottom inner cover 210 placed over the bottom and meeting the top out cover along a seam 214. In one embodiment, the outer and inner covers are connected by a zipper or other releasable fastener to provide for removal of the covers and access to the internal layers and transducers contained in the internal layers.

In one embodiment, the mattress includes a plurality of cut-out holes 212 or other suitable voids or channels contained within the layers to accommodate transducers being incorporated into the mattress. In one embodiment, the cut-out holes are located in a single layer. In another embodiment, a plurality of distinct and separate cut-out holes are located in multiple layers of the mattress. In one embodiment, one or more cut-out holes extend through two or more layers. In one embodiment, the mattress includes three cut-out holes. As illustrated, the cut-out holes are disposed in the first supportive poly base foam layer.

The layers of the mattress can also include one or more slits or channels (not shown) extending through the layers from the cut-out holes. These slits or channels provide routing for cables extending from transducers disposed in the cut-out holes. In one embodiment, each cut-out hole is a cylindrical hole having a circular cross-section. Suitable diameters for the circular cross-section include, but are not limited to, about 11 cm, i.e., from about 4 inches to about 4.5 inches. However, larger or smaller circular cross-sections can be used. In addition to cylindrical holes having a circular cross-section, holes having rectangular cross-sections or cross-sections having other polygonal shapes can be used. Cut-out holes or pockets can also be provided along the edges of the mattress layers. These pockets extend from the head end surface, the foot end surface or the opposing side surfaces into one or more layers of the mattress from the edges.

In general, the cut-out holes are sized and shaped to accommodate the transducers placed within the mattress. The cut-out holes are size to provide contact between the materials of the mattress and the transducer to facilitate transmission of the desired vibrations or sonic frequencies through the mattress. In one embodiment, the transducers are circular, or disc shaped. The transducers are configured to receive sonic signals or sounds corresponding to a desired range of frequencies or frequency band and to communicate the desire range of frequencies into the layers of the mattress adjacent the transducers or outward from one of the surfaces of the mattress. In one embodiment, internal transducers receive low frequencies of the sound or sonic signal and communicate these lower frequencies through the layers of the mattress to the occupant as vibrations or sonic waves. External transducers receive high frequencies of the sound signal, e.g., high end audio, and communicate these higher frequencies outward from the mattress through the air toward the occupant as audible sounds.

Figure 7:
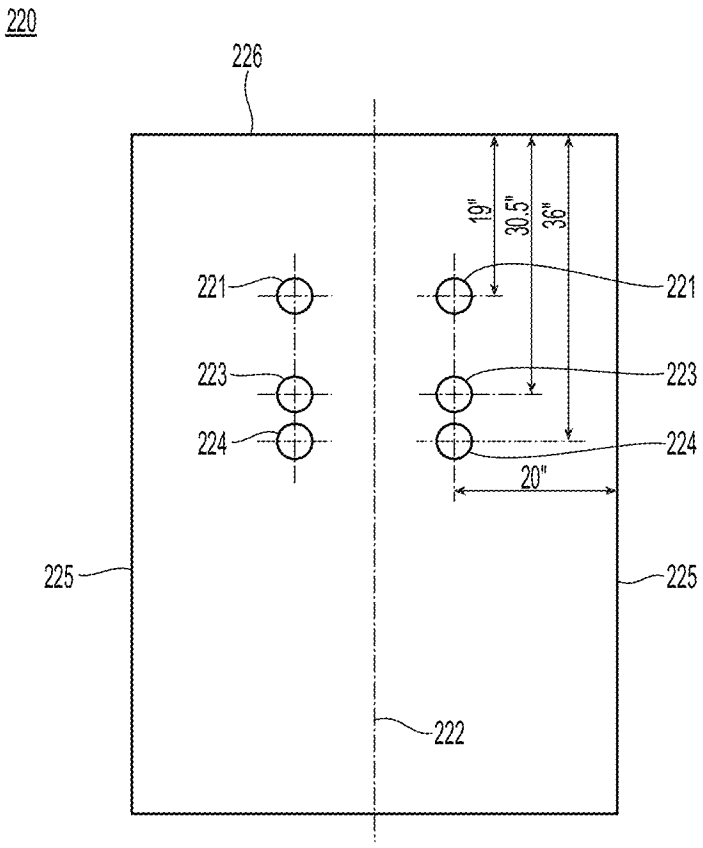
FIG. 7 is a schematic representation of an embodiment of the location of cut-out holes for transducers in a layer of the multi-layered mattress.

Referring to FIG. 7, an embodiment of a first supportive poly base foam layer 220 is illustrated. As illustrated, the first supportive poly base foam layer is sized for a queen mattress. The first supportive poly base foam layer includes six cylindrical cut-out holes. Preferably, each cut-out hole passes completely through the poly base foam layer. In one embodiment, each cut-out hole has a 11 cm or 4 inch diameter circular cross-section. The six cut-out holes are arranged as two sets of three cut-out holes positioned on either side of a center line 222 of the first supportive poly base foam layer. In one embodiment, each cut-out hole is centered 20 inches from one of the opposing sides 225 of the first supportive poly base foam layer. Therefore, each set of three cut-out holes is centered along a common line running the length of the mattress. In one embodiment, each set of three cut-out holes includes a shoulder area cut-out hole 221 centered 19 inches from a head end 226 of the first supportive poly base foam layer. In one embodiment, each set of three cut-out holes includes a pair of lumbar area cut-out holes, a first lumbar area cut-out hole 223 positioned 30.5 inches from the head end and a second lumbar area cut-out hole 224 positioned 36 inches from the head end.

Figure 8:
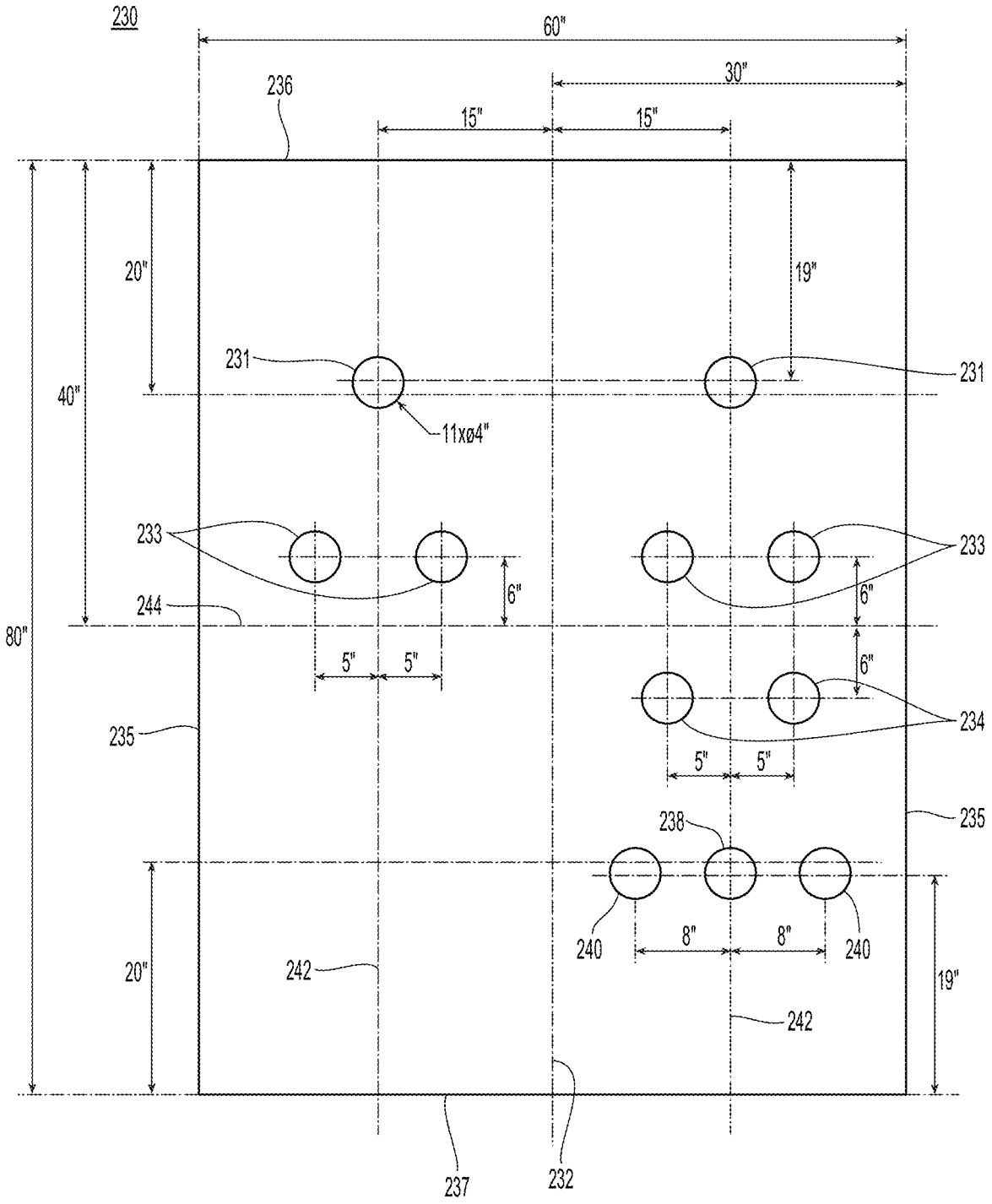
FIG. 8 is a schematic representation of an embodiment of the location of cut-out holes for transducers in a layer of the multi-layered mattress.

Referring now to FIG. 8, another embodiment of a first supportive poly base foam layer 230 is illustrated. As illustrated, the first supportive poly base foam layer is sized for a queen mattress. The first supportive poly base foam layer includes eleven cylindrical cut-out holes, each with an 11 cm or 4 inch diameter circular cross-section. The eleven cylindrical cut-out holes include six cut-out holes positioned between a head end 236 and a midline 244 running across the width of the first supportive poly base foam layer. In one embodiment, the six cut-out holes are arranged as two sets of three cut-out holes positioned on either side of a center line 232 running the length of the first supportive poly base foam layer thirty inches from either one of the two opposing sides 235. The eleven cylindrical cut-out holes also include an additional five cut-out holes positioned between the foot end 237 and the midline. As illustrated the five cut-out holes are located only on a single side of the center line 232; however, the first supportive poly base foam layer can include five cut-out holes on both sides of the center line for a total of sixteen cut-out holes.

The cut-out holes include a pair of shoulder area cut-out holes 231 centered 19 inches from the head end 236 of the first supportive poly base foam layer and 15 inches on either side of the center line 232. The plurality of cut-out holes includes four lumbar area cut-out holes 233 arranged as two pairs of lumbar area cut-out holes. Each pair of lumbar area cut-out holes are located on either side of the center line 232 and are centered 6 inches above the midline 244 running across the width of the first supportive poly base foam layer. For each pair of lumbar area cut-out holes, each lumbar-area cut out hole is centered 5 inches on either side of a bisecting line 242 that bisects that half of the first supportive poly base foam layer.

The cut-out holes located below the midline include a pair of upper leg, or lower lumbar, cut-out holes 234 centered 6 inches below the midline. Each upper leg cut-out hole is centered 5 inches on either side of the bisecting line. The plurality of cut-out holes also includes three lower leg cut-out holes. The three lower leg cut-out holes include a center lower leg cut-out hole 238 centered on one of the bisecting lines and 19 inches from the foot end 237 of the first supportive poly base foam layer. The three lower leg cut-out holes also include a pair of outer lower leg cut-out holes 240, each centered 8 inches from the bisecting line and 19 inches from the foot end. For any given arrangement of cut-out holes, the first supportive poly base foam layer can include a transducer in each cut-out hole or in only a portion of the cut-out holes, e.g., in one or more of the cut-out holes. In one embodiment, the transducers in these cut-out holes are subwoofers, configured to receive the lower frequencies or frequency bands of the audible sounds, sonic frequencies or vibrations.

Referring to FIG. 9, a chart illustrates the sizing and configuration of twin size, queen size and king size embodiments of multi-layered mattress and cut-out holes. The chart provides the sizing and thicknesses of the individual layers and the overall sizing and thickness of the twin, queen and king embodiments. The chart also provides a description of the density of the internal layers and the number and size of the cut-out holes in the first supportive poly base foam layer. These cut-out holes are arranged to contain one or more subwoofers or transducers for delivering the desired frequencies of audible sounds, sonic frequencies and vibrations, e.g., lower frequencies, through the layers of the mattress to the occupants of the mattress. Tweeters or transducers for higher frequencies can be located in other areas of the mattress or can be attached to the furniture outside of the mattress, e.g., adjacent the mattress or under the mattress. The dimensions of the top and bottom outer covers and the zipper connecting the top outer cover and the bottom inner cover are also provided. As illustrated, these two covers fit together and partially overlap to keep the overall thickness of the mattress within 12 inches.

The transducers are located in accordance with the portion or body part of the occupant to receive the desired sounds, tactile sensations or vibrations. In one embodiment, the cut-out holes, and therefore the transducers, are located to accommodate the largest percentage of the potential population of users or occupants, i.e., the largest variation in the size of occupants.

Referring to FIG. 10, in one embodiment, sizing and location of the cut-out holes and transducers utilizes an anthropometric chart 850 that provides the anthropometric measurement for both male and female humans. These anthropometric measurements provide the length, dimensions or locations for a plurality of body measurements 853 as measured from the bottom of the feet. These measurements are provided for both male 854 and female 855 members of the population and are expressed in both meters 856 and inches 857 that cover a given percentage of the population, i.e., 5%, 50% and 95%. For example, a stature of up to 69 inches covers 50% of the male population 851, and a mid-shoulder height of up to 57 inches covers 95% of the female population 852.

These data are used in determining the position of each cut-out hole as measured, for example, from the head end of the multi-layered mattress. These data are also used to determine the position of the external transducers for delivery of the high end frequencies adjacent a head area of an occupant. A zone location chart 860 is generated to summarize the ranges of body measurements that accommodate from 5% and 95% of the male population 869 and female population 868. As illustrated, the measurements are charted for the stature or height 865, the mid-shoulder height 866 and the buttocks height 867. The measurements are then used to identify zones within the mattress. In one embodiment, the measurements are subtracted from each other and added to a 3 inch border zone to determine the location of the dividing lines between the first, second and third zones to cover either 5% or 95% of the male and female population.

Subtracting the mid-shoulder height from the stature and adding 3 inches yields a first zone length 862. Subtracting the buttocks height from the mid shoulder height yields the second zone length 863. Adding the first zone length to the second zone length provides the location of the beginning of the third zone 864, i.e., the spacing of the third zone from the head end. These measurements in association with the percentage of the male and female population accommodated by these zone measurements are used to determine the size and location of the zones along the mattress that accommodated the desired percentage of both male and female humans. Suitable percentages include, but are not limited to at least 50%, at least 75% and at least 95%. The location of the transducers, for example, the cut-out holes holding the transducers are selected to be in a given zone to deliver the desired frequencies to a given body portion of the occupant of the mattress or a location on the body of the occupant of the mattress. These measurements can also be used to determine the location of cut-out holes along the length of the mattress to cover a desired percentage of the population for a desired zone. While three zones are illustrated, the measurements can be used to identify more than three zones.

The transducers incorporated into the mattress include one or more of transducers configured and positioned to deliver sounds and sonic waves through the support surface of the furniture or mattress toward the occupant of the furniture. Any suitable transducer capable of producing audible sounds, sonic waves or frequencies, or vibrations in the desired frequencies and waveforms that is known and available in the art can be used, In general, these transducers convert electrical signals into sound waves or vibrations in the desired frequency or range of frequencies. In one embodiment, the transducer receives low frequencies and is referred to as a subwoofer or woofer. In one embodiment, the transducer is a piezoelectric transducer. In one embodiment, the transducer is a tactile transducer that produces vibrations at the desired frequencies.

Figure 11:
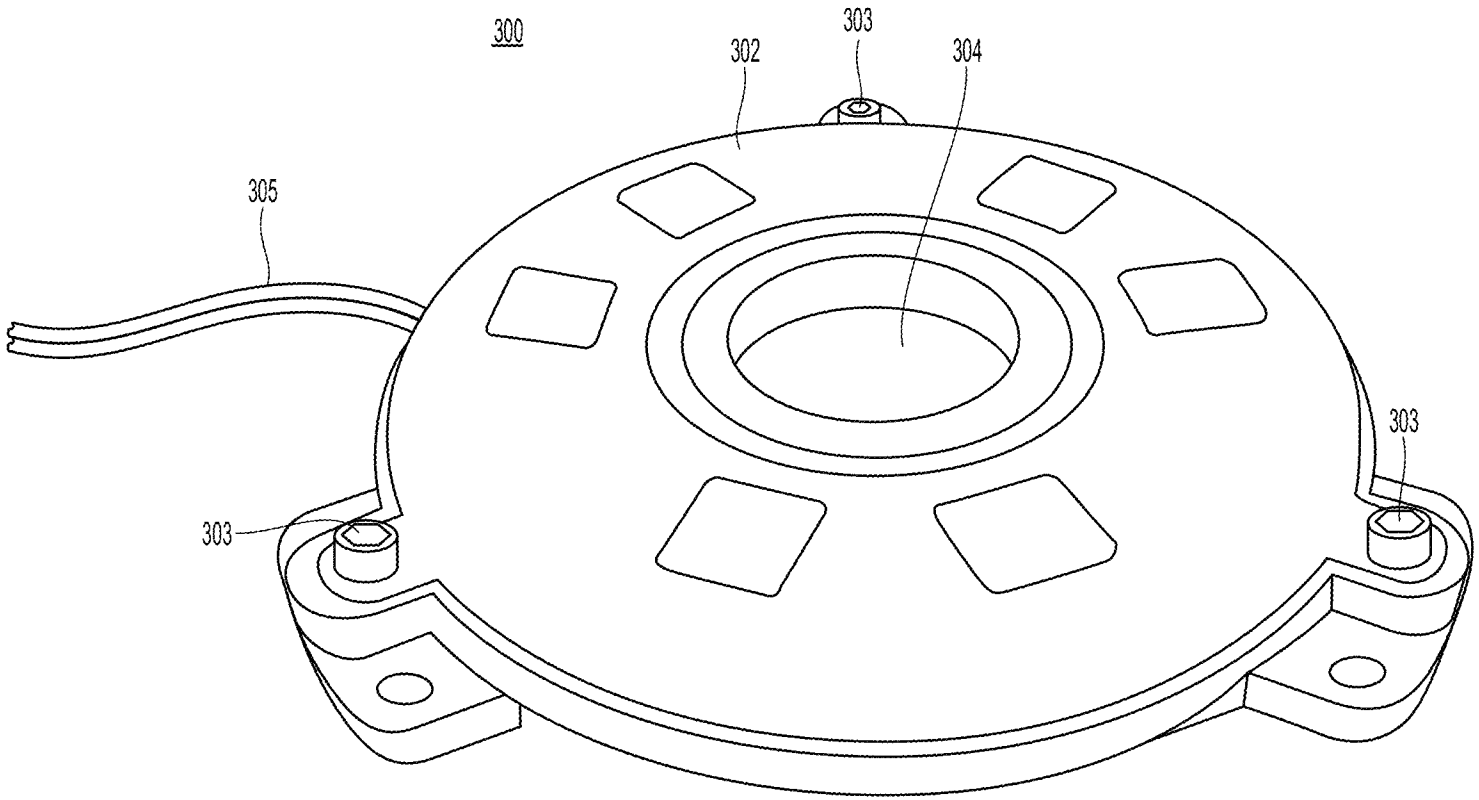
FIG. 11 is a top perspective view of an embodiment of a transducer.
Figure 12:
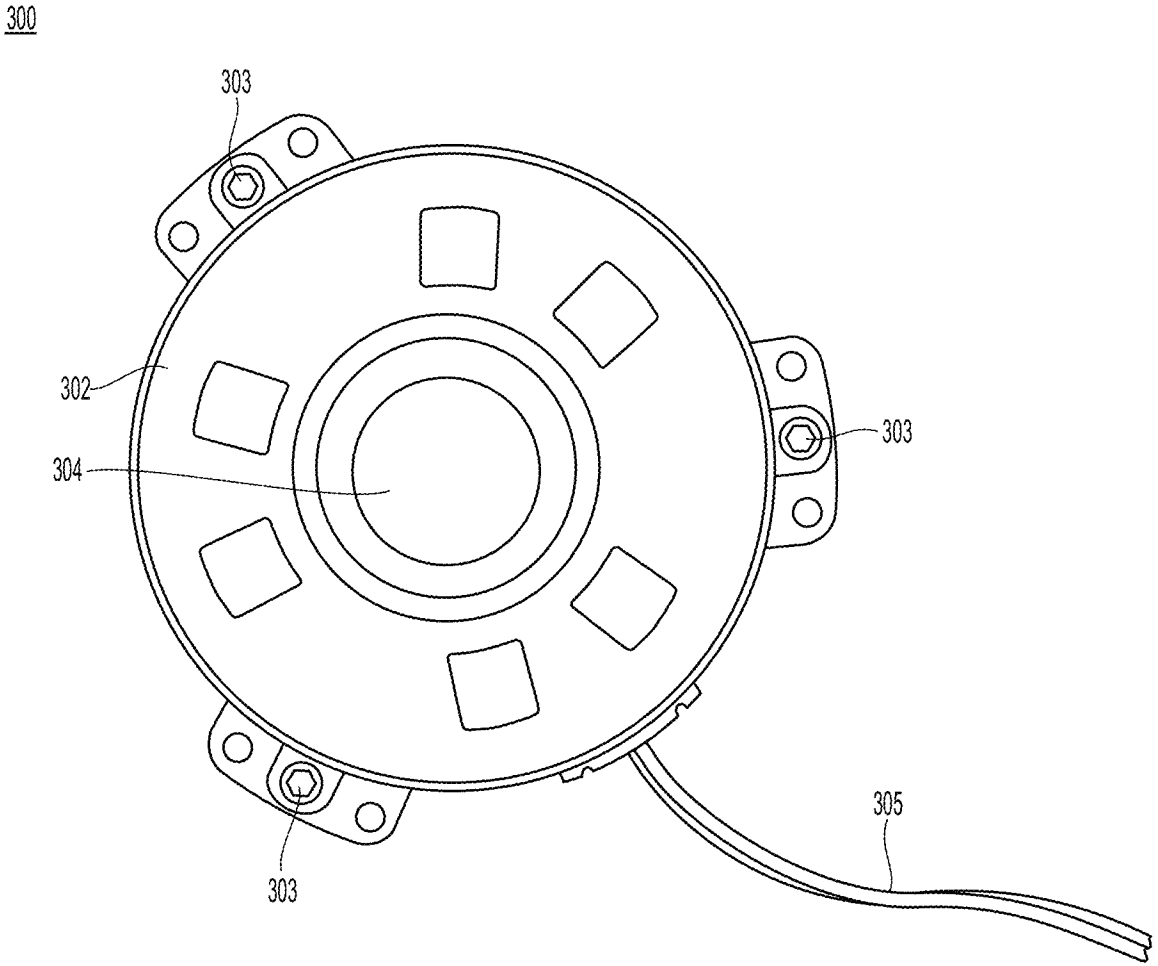
FIG. 12 is a top view of an embodiment of a transducer.

Referring to FIGS. 11 and 12, an embodiment of an individual transducer 300 is illustrated. The transducer includes an outer case 302. In one embodiment, the outer case is a two part "clam shell" case made of a material such as a plastic or a polymer material. The two parts of the outer case are joined together using a plurality of fasteners 303, for example screws. The transducer includes a vibrating piston 304 disposed concentrically within the outer case. In one embodiment, the piston is a metal piston. The piston translates electrical signals and pulses into vibrations that are communicated to the outer case, which is in contact with one or more layers of the mattress. In one embodiment, the electrical signals are used to drive an electric coil that causes the piston to oscillate back and forth along the central axis of the disc shaped transducer in accordance with the desired frequencies and produce vibrations. In one embodiment, the entire transducer vibrates, and these vibrations are transferred from transducer into the mattress or other support surface. In another embodiment, the vibrations are transferred directly from the piston into the mattress or support surface.

The electrical signals are communicated to the piston through one or more electrical leads 305 passing through the outer case and routed through the layers of the mattress to a control system containing control electronics. In one embodiment, the ends of the leads opposite the piston are configured as a plug that is easily attached to and detached from the control electronics. In addition, the transducer is configured to be removable from a cut-out hole. This provides for serviceability and replacement of the transducer.

In one embodiment, the mattress also includes one or more external transducers or external speakers configured and positioned to deliver sounds and sonic waves outward from the furniture or transducers configured and positioned to deliver sounds and sonic waves outward from the support surface of the furniture. In one embodiment, the external transducers are positioned adjacent the furniture, for example, on the floor, wall or a table adjacent the furniture or furnishings. In one embodiment, these transducers are configured to deliver the higher frequency sounds and can be referred to as tweeters. These higher frequencies are intended to be delivered as audible sounds, for example, high end audio. In one embodiment, the transducers are incorporated into the mattress and are exposed along one of the surfaces, sides or ends of the mattress. As an alternative to being mounted on the sides or side surfaces of the mattress, the transducers can be attached to the platforms, foundations or frames supporting the mattress and located within the platforms, foundations or frames to deliver the desired sounds or sonic frequencies through the air to areas adjacent the head end of the mattress.

Figure 13:
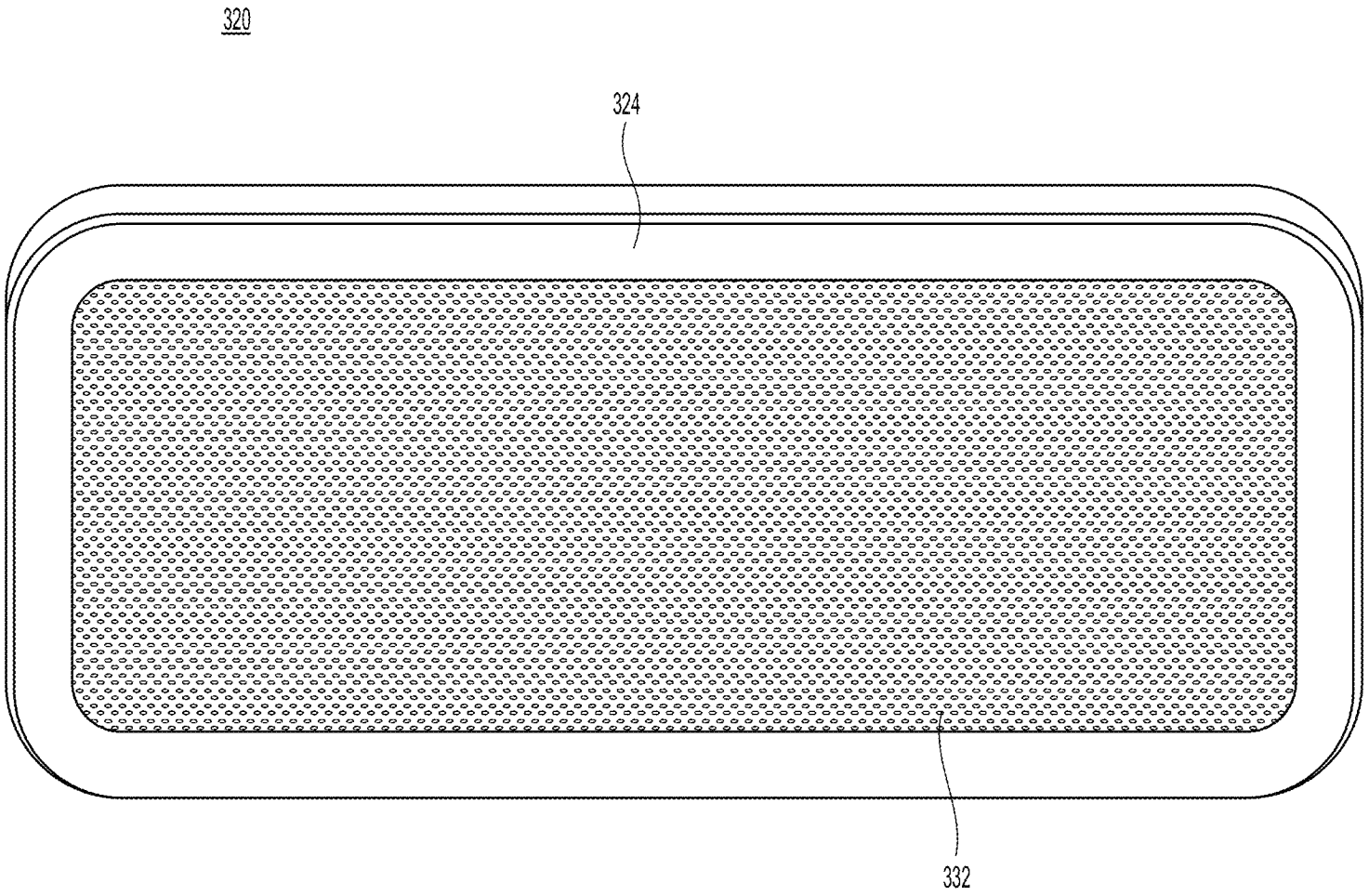
FIG. 13 is a front perspective view an embodiment of an external transducer for delivering higher sonic frequencies.
Figure 14:
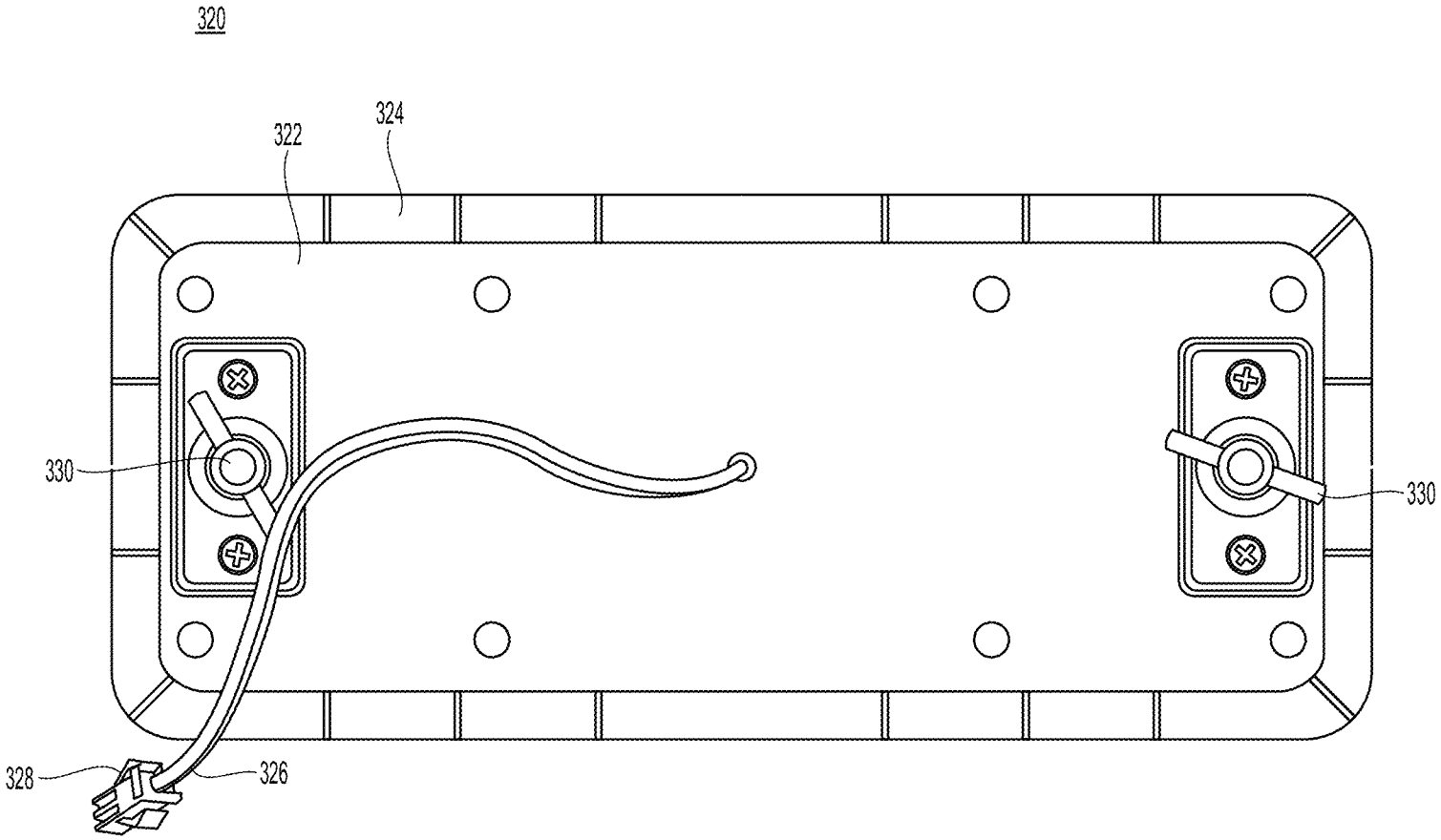
FIG. 14 is a back view the external transducer for delivering higher sonic frequencies.

Referring to FIGS. 13 and 14, an embodiment of a transducer 320 or speaker, e.g., an external transducer or high-end frequency transducer, is illustrated. In one embodiment, the speaker or transducer is integrated into a side surface of the mattress (FIG. 1 at 118), for example, into the second supportive poly base foam layer of the mattress. The transducer is located adjacent the head end of the mattress and is exposed externally from the mattress to deliver the desired frequencies of sounds or sonic frequencies to the occupant of the mattress, e.g., the higher frequencies, without having to communicate those frequencies through the mattress. In one embodiment, multiple transducers or externally exposed transducers are located along the sides or head end surfaces of the mattress. In one embodiment, two external transducers or external speakers are provided, for example, one on either side of the head end of the furniture or mattress. In one embodiment, the external transducers or speakers are located in a bed base or foundation (FIG. 1 at 120), e.g., an adjustable foundation, that is supporting the mattress. For other types of support surfaces, e.g., chairs, the external transducers are located to deliver audible sounds near the head of the occupant of the support surface.

In one embodiment, each external transducer is an audio speaker disposed within a rectangular case 322 having a mounting flange 324 or bezel configured to engage a surface, e.g., a side surface, of the mattress or mattress foundation. Sounds produced by the transducer exit the case through a perforated cover 332. In one embodiment, the case includes a plurality of fasteners 330 that provide for removable mounting of the transducer, for example, to the framing within the bed foundation. Electric leads 326 extend through the case to contact the components of the transducer or speaker that generate the desired sounds, e.g., the voice coil. The opposite end of the electric leads includes a plug 328 providing connectivity to the control system containing the control electronics. The control system and control electronics provide the desired sonic frequency band output to each external transducer or speaker.

Figure 15:
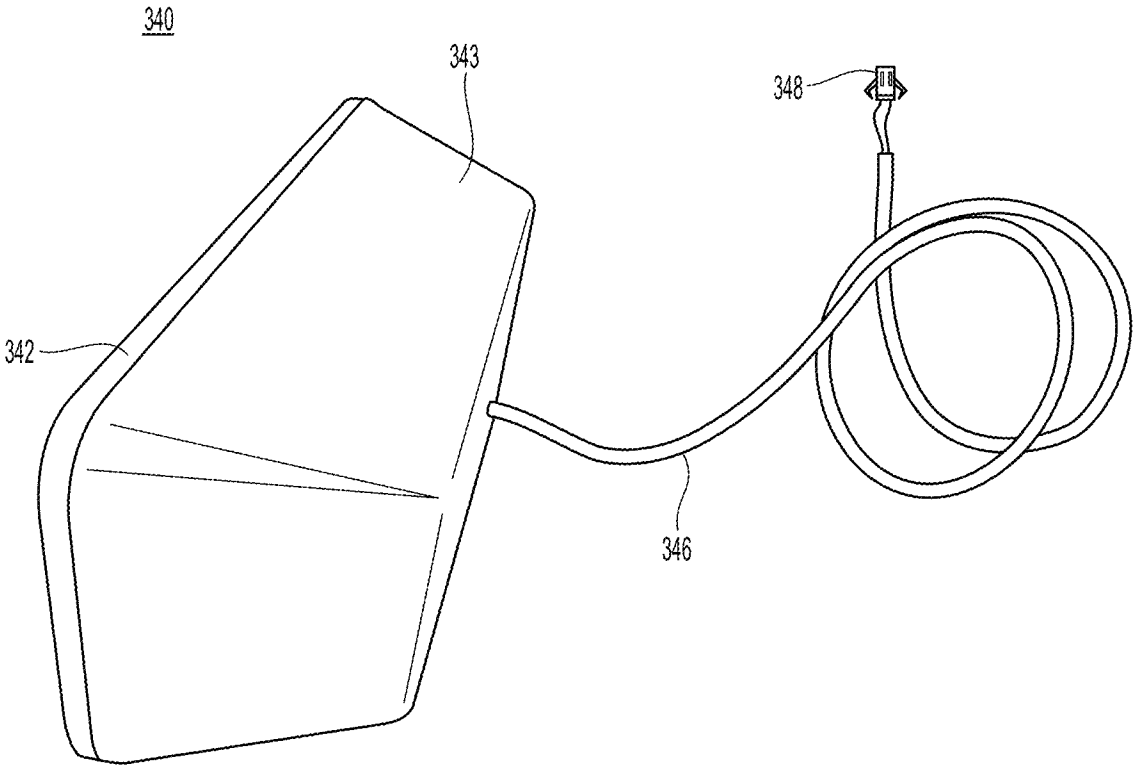
FIG. 15 is a back perspective view from the top of another embodiment of an external transducer for delivering higher sonic frequencies.
Figure 16:
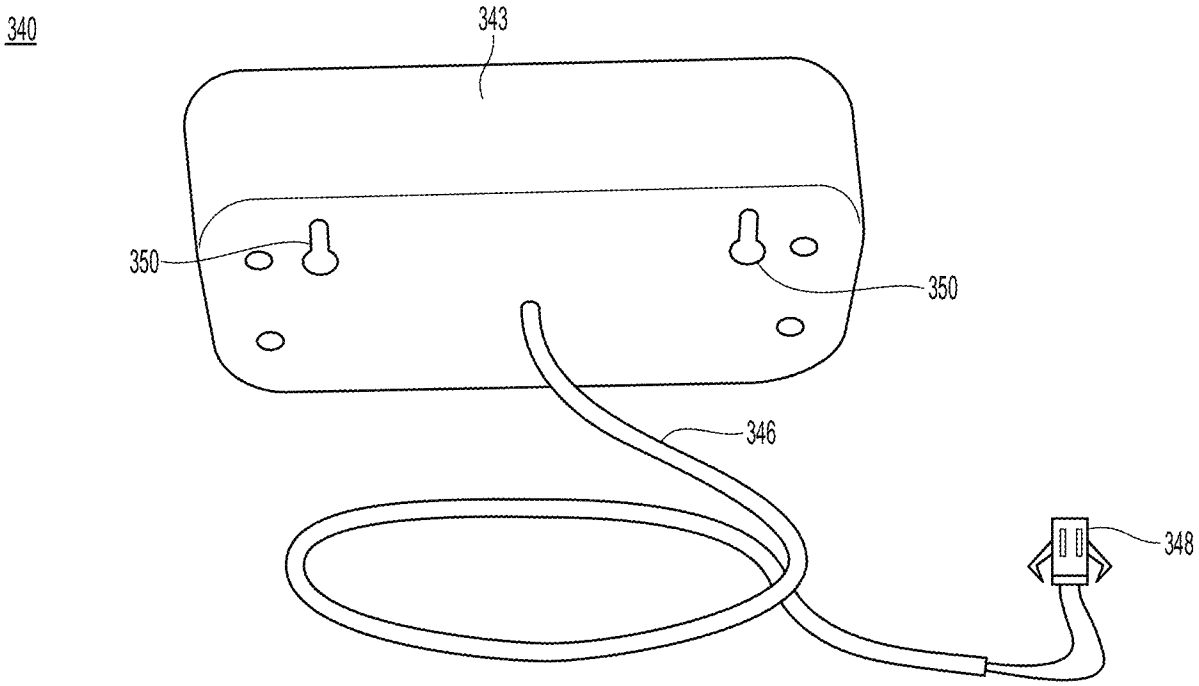
FIG. 16 is a back view of the other embodiment of the external transducer for delivering higher sonic frequencies.

Referring now to FIGS. 15 and 16, another embodiment of a transducer 340, e.g., an external transducer or high-end frequency transducer, is illustrated. In one embodiment, the transducer includes an audio speaker disposed within a generally rectangular case 343 configured to be embedded in an exposed cavity in a surface, e.g., a side surface, of the mattress or the fame or foundation supporting the mattress. Sounds produced by the transducer exit the case through a perforated fabric cover 342. To provide for mounting, the case includes a plurality of slotted mounting holes 350 to accept, for example, the heads of mounting screws or mounting bolts. These mounting screws or bolts can be attached to framing or embedded within the mattress. Electric leads 346 extend through the case to contact the components of the transducer that generate the desired sounds, e.g., the voice coil of the speaker. The opposite end of the electric leads includes a plug 348 providing connectivity to the control system and control electronics. While illustrated as two different types of speakers or transducers, any type of speaker or transducer that can deliver or broadcast audible sounds and sonic frequencies in the desired frequency range can be used, e.g., tweeters.

A given sound or sonic signal to be delivered to the internal and external transducers is parsed or filtered by frequency into a plurality of frequencies, frequency ranges or sonic frequency bands. In one embodiment, the sounds are parsed by setting a crossover to parse a single sound into two or three output signals, each having a separate frequency band from low to high. Any suitable crossover or audio crossover circuit known and available in the art, including 2-way and 3-way cross over circuits can be used. These crossover circuits are contained in the control system and control electronics that are in communication with the internal transducers and external transducers. Suitable frequency bands include, for example, a high sonic frequency band and a low sonic frequency band. In one embodiment, the frequency bands include a high sonic frequency band, a middle sonic frequency band and a low sonic frequency band. In one embodiment, the high sonic frequency band includes frequencies greater than about 2000 Hz. In one embodiment, the high sonic frequency band includes frequencies from about 2000 Hz to about 20000 Hz. In one embodiment, the low end frequency band includes frequencies lower than about 2000 Hz. In one embodiment, the low end frequency band includes frequencies lower than 200 Hz, lower than 100 Hz or lower than 80 Hz. In one embodiment, the low end frequency band includes frequencies from about 20 Hz to about 200 Hz. In one embodiment, the middle sonic frequency range includes frequencies from about 20 Hz to about 500 Hz.

Each transducer can receive the same audible sound or sonic frequency or a distinct sound or sonic frequency. In one embodiment, different frequencies or frequency ranges are delivered to individual transducers based on the location of the transducers. The higher frequency bands or high end audio sounds are delivered to the transducers or tweeters exposed from the surface of the mattress or framing that contain audio speakers, i.e., to the external transducers. The low frequency bands and middle frequency bands or portions of the sound are delivered to the transducers, e.g., subwoofers, disposed within the mattress. For a 2-way crossover, the higher frequency is delivered to all external transducers and the lower frequency is delivered to all internal transducers. Therefore, the given sound is delivered to the occupants positioned on the top surface of the mattress in both an audible format, i.e., high end frequencies, and a tactile format, i.e., low end and middle range frequencies.

In one embodiment, the sounds and sonic frequencies are selected and controlled to solicit a beneficial, therapeutic or physiological response for the persons laying on the mattress. For example, the transducers are used to deliver sleep sounds adjacent to the head of the occupant. In addition, associated soothing tactile sensations are delivered through the mattress to the occupant for enhanced rest. These therapeutic tactile sensations can be delivered independent of the delivery of audible sounds. Therefore, the internal transducers can be used to deliver vibrations or massage frequencies to the occupant independent of the delivery of any audible frequencies or sounds to the occupant. In one embodiment, the internal transducers are used to deliver vibrations or massage frequencies and wave patterns without the delivery of any audible sounds. Thus, exemplary embodiments are operated as furniture or furnishing providing therapeutic massage to the occupant. In one embodiment, therapeutic massage is controlled using the control system and control system firmware independent of any sonic signal communicated to the control system.

In one embodiment, the mattress includes a control system in communication with the transducers to deliver the desired sounds or sonic frequencies to each transducer. Therefore, the operation and output of all transducers are controlled by the same control system. This provides for an integrated immersive experience where both auditory stimulation and tactile stimulation are coordinated and delivered simultaneously to an occupant of the furniture. The control system controls the transducers, parses the sonic signal or sound into independent frequencies or frequencies bands, produces the sound or sonic frequencies in accordance with desired wave patterns and delivers the signals to the individual transducer to produce the sound or sonic frequencies in the individual transducers. Sounds or sonic signals include, for example, music, soundtracks associated with movies or television programs, audio associated with games or online gaming platforms, audio from concerts, audio from websites including audio associated with multi-media content, audio associated with live streaming and audio associated with video conferencing. When the furniture includes a mattress, the control system can be contained completely within the mattress, can be located outside the mattress, for example, in the foundation or frame on which the mattress is supported, or can have components located both within the mattress and in the foundation or frame.

Figure 17:
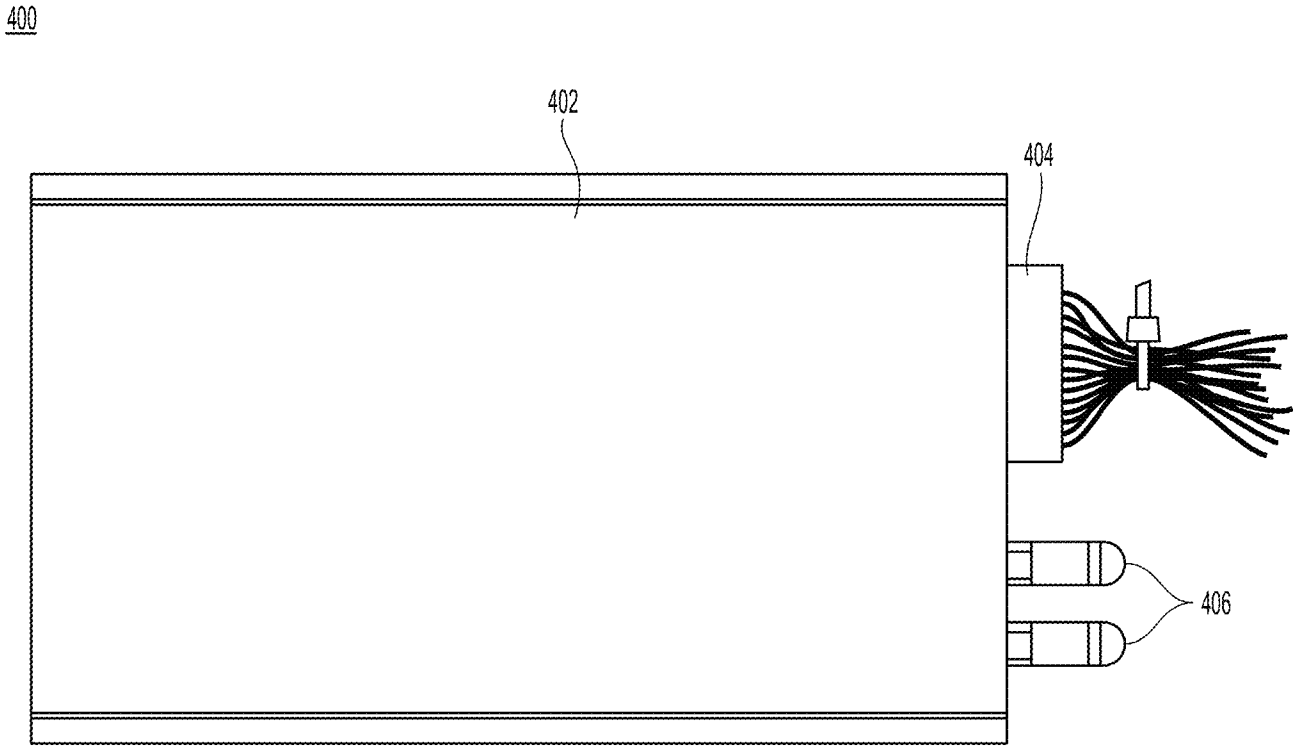
FIG. 17 is a top view of an embodiment of the control system containing the firmware for operating the transducers.
Figure 18:
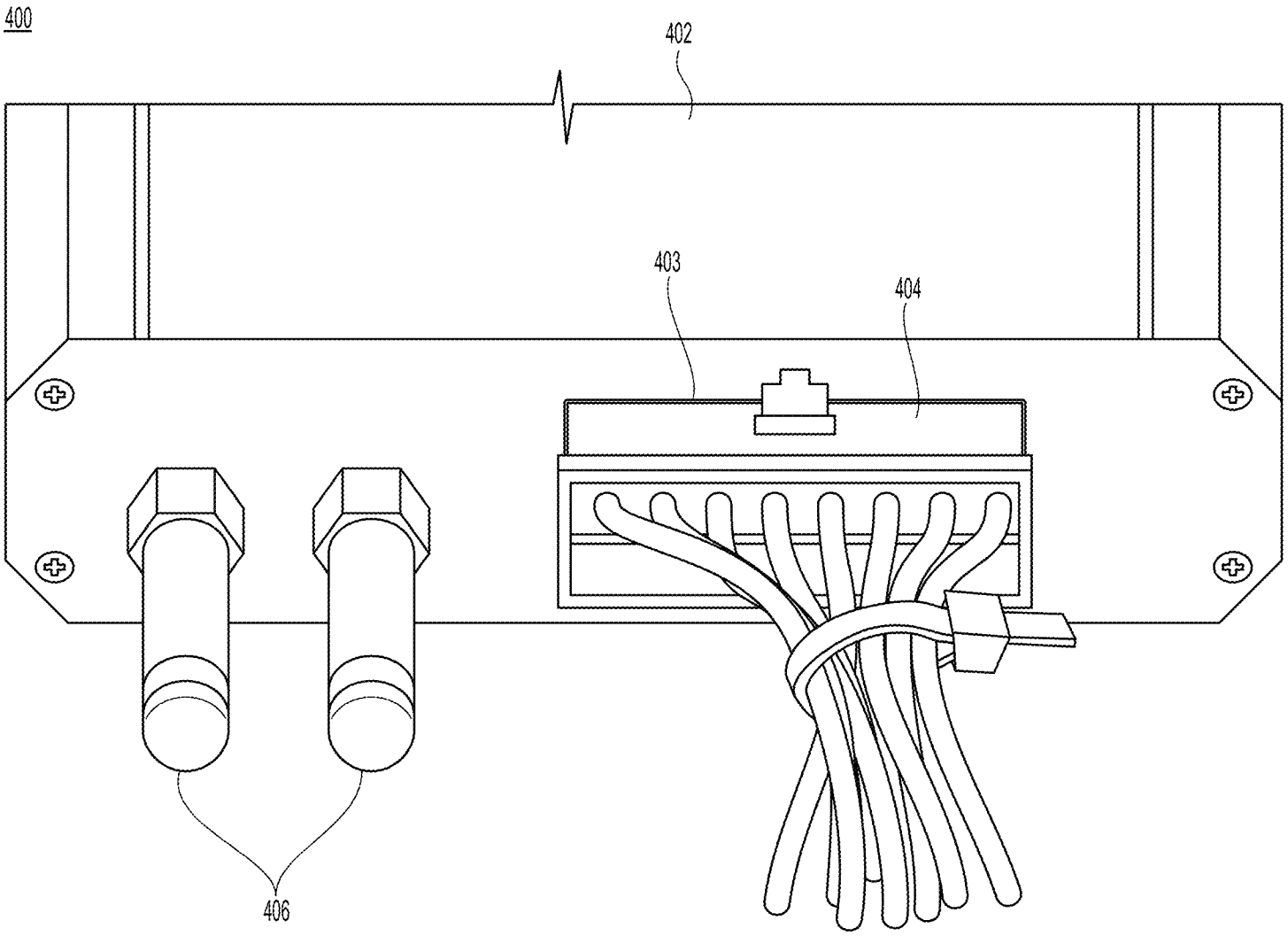
FIG. 18 is an end view from a first end of the control system containing the firmware for operating the transducers.
Figure 19:
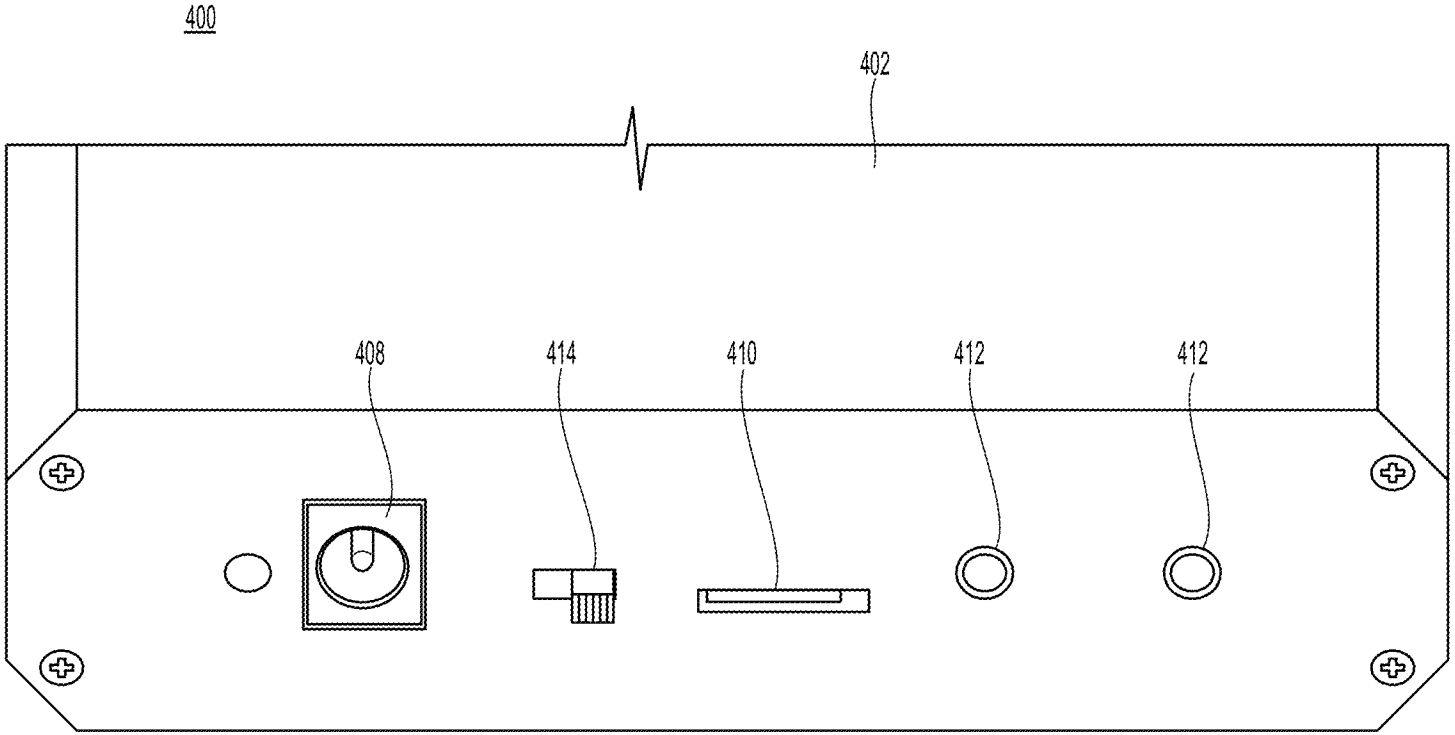
FIG. 19 is an end view from a second end of the control system containing the firmware for operating the transducers.

Referring to FIGS. 17-19, in one embodiment, the control system is provided as at least one module containing firmware 400 configured to manage the parsing and delivery of the sound and audio, vibrational and thermal characteristics of a continuous mode of operation. In one embodiment, the control system module containing firmware is configured and contained within an outer case 402. Disposed within the outer case is all electronics, processors, memory and software to provide for the receipt, filtering and parsing of sounds and sonic signals and the delivery of the parsed sounds to the external and internal transducers. Therefore, the output and operation of all transducers is controlled by the control system. The control system can delivery unique frequency bands to each transducer and can operate the internal transducers in a massage mode independent of the external transducers. In one embodiment, the outer case is placed within the furniture or within layers of the mattress. Alternatively, the outer case is mounted to the furniture bed foundation or bed frame adjacent to or under the furniture or mattress. In one embodiment, the case is placed adjacent to or under the furniture, mattress, bed foundation or bed frame.

The case includes at least one control or communication port 403 configured to accept one or more plugs 404 to provide communication between the firmware and the transducers, i.e., to deliver the signals that produce the desired sounds or sonic frequencies to each transducer. In one embodiment, a single plug is used that provides connectivity to all of the transducers, for example, through an external electrical manifold (not show). Each transducer is plugged into the electrical manifold. In one embodiment, each separate plug associated with each transducer is plugged directly into the control or communication port. The firmware also supports wireless communication through, for example, BlueTooth, WIFI and Cellular type communication protocols. In one embodiment, wireless communication is used to communicate frequency bands from the control system to one or more internal or external transducers. In one embodiment, wireless communication is used to receive the desired sonic signal from sources external to the furniture, e.g., a television, smart phone, gaming module or computer. Therefore, the case includes one or more exterior antennas 406 to facilitate the desired wireless communication.

Figure 20:
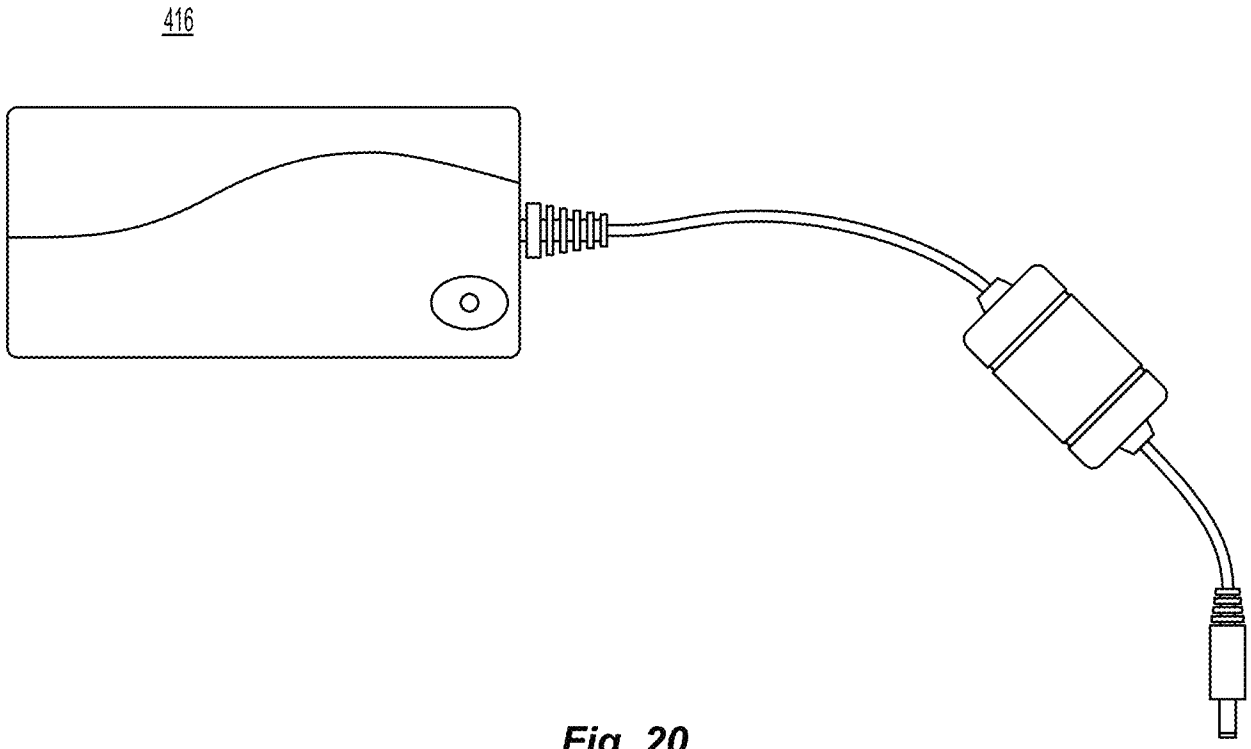
FIG. 20 is a view of an embodiment of a power supply transformer for providing power to the control system.

The case can provide for other types and formats of connections, for example, auxiliary connections, coaxial connections, HDMI connections, USB ports and audio cable connectors including RCA jacks. In one embodiment, the case includes an SD card interface 410 and one or more audio input jacks 412. These connections are used to communicate the desired sound or sonic signal to the control system. Power is provided to the control system and the outer case through a power connector 408. The power connector is in communication with a source of power, for example, through a suitable power transformer 416 (FIG. 20). The power connector is in communication with a power switch 414. In addition to filtering the desired audible sounds, arrangements of sonic frequencies and vibrations by frequency, the module containing firmware can also control other functions of the bed, for example, heating, cooling, massage and adjustment.

Figure 21:
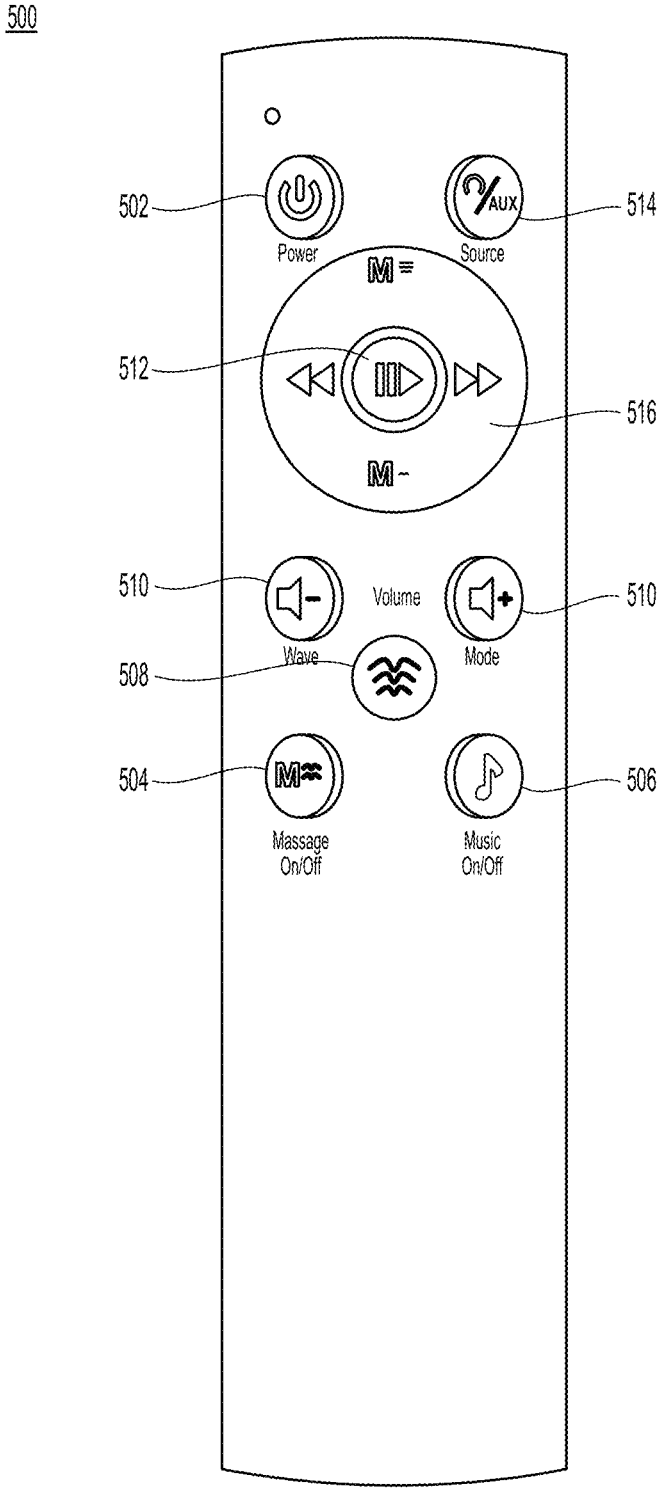
FIG. 21 is a front view of an embodiment of a wireless remote for controlling the firmware and functioning of the transducers.

Referring to FIG. 21, in one embodiment, a wireless remote 500 is provided that can communicate with the control system or firmware using any suitable wireless communication protocol. The wireless remote allows the occupants of the mattress to control all functions of the control system and transducers. The remote includes a power button 502 to turn the system on and off. A source button 514 provides for selection of the source of the sounds or vibrations delivered to the transducers, e.g., a television, a computer or memory, e.g, an SD card. A start and pause button 512 allows for initiation or pausing of the selected sounds, vibrations or operational modes. A ring-shaped switch 516 surrounds the start and pause button and provides for scrolling through a list of functions or sounds and for the increase or decrease in the intensity of massage waves. A wave mode button 508 provides access to different types of massage wave forms. A pair of volume buttons 510 provide for an increase or decrease in the volume of audible sounds. A massage mode button 504 allows the user to put the control system into massage only mode or combined tactile and audio sound delivery mode. A music button 506 allows a user to select only the delivery of audible sounds through the appropriately configured external transducers.

Exemplary embodiments are also directed to method of making the mattress and to methods of controlling and operating the incorporated transducers within the mattress. In one embodiment, exemplary embodiments are directed to a method for delivering audible and tactile sensations to an occupant of a furnishing such as a mattress or chair. Internal transducers located between a top surface for supporting the occupant and a bottom surface of the furnishing. In one embodiment, a plurality of internal transducers are positioned within the furnishing, and each internal transducer is positioned relative to a given location on the occupant. In one embodiment, each transducer is positioned in one of a plurality of distinct zones extending along a length of the mattress from the head end surface to the foot end surface. The distinct zones are selected to align with given body portions of a desired percentage of a population of occupants, e.g., 5%, 50% or 95%. The internal transducers are used to communicate sonic frequencies, e.g., a low sonic frequency band, through the furnishing to the top surface.

In addition, at least one external transducer or speaker is positioned in the furnishing and is exposed from an external surface of the furnishing to communicate audible frequencies or audio outward from the furniture or towards a desired location on the furniture at which the head of an occupant is located. In one embodiment for a mattress, each external transducer extends through and is exposed from the surfaces at the head end of the mattress or from one of the opposing side surfaces adjacent the head end. In one embodiment where the furnishing includes a foundation or base having a support surface for supporting the mattress, each external transducer is disposed in one of the vertical sides and communicates sonic frequencies outward from the vertical sides adjacent the head end of the mattress. In one embodiment, the external transducers are located outside but adjacent the furniture. The external transducers are used to communicate sonic frequencies, e.g., a high sonic frequency band, externally to the top surface. The sonic frequencies from each external transducer is not communicated through the furnishing.

A control system is used to receive a given sonic signal. The sonic frequencies are filtered into at least two, three or more sonic frequency bands. In one embodiment, the sonic signal is filtered into three frequency bands, a low sonic frequency band, a middle sonic frequency band and a high sonic frequency band. In one embodiment, the sonic frequencies are filtered into a low sonic frequency band containing frequencies less than 2000 Hz and a high sonic frequency band containing frequencies greater than 2000 Hz. In one embodiment, the low sonic frequency band contains frequencies from about 20 Hz to about 200 Hz, and the high sonic frequency band contains frequencies from about 2000 Hz to about 20,000 Hz. In one embodiment, the control system uses a crossover circuit to filter the sonic frequencies. The higher sonic frequency bands are communicated to the external transducers, and the lower sonic frequency bands, e.g., low and middle bands, are communicated to the internal transducers. The control system communicates the desired frequency bands through a wired or wireless connection to each internal and external transducer. the control system comprises a crossover circuit to filter the given sonic signal into the sonic frequency bands.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. Furniture for delivering audible and tactile sensations to an occupant, the furniture comprising:

a top surface for supporting the occupant;

a bottom surface opposite the top surface;

at least one internal transducer disposed in the furniture between the top surface and the bottom surface to communicate sonic frequencies through the furniture to the top surface;

at least one external transducer positioned to communicate sonic frequencies externally to the top surface; and a control system in communication with each internal transducer and each external transducer, the control system configured to receive a given sonic signal, filter the given sonic signal into at least two sonic frequency bands, communicate higher sonic frequency bands to the external transducers and communicate lower sonic frequency bands to the internal transducers.

2. The furniture of claim 1, wherein:

the furniture further comprises a mattress comprising:

a head end surface spanning from the top surface to the bottom surface;

a foot end surface spanning from the top surface to the bottom surface; and two opposing side surfaces spanning from the top surface to the bottom surface, each opposing side surface extending from the head end to the foot end;

wherein each internal transducer is spaced from the head end surface, the foot end surface and the two opposing side surfaces.

3. The furniture of claim 2, wherein the furniture comprises a plurality of internal transducers, each internal transducer positioned to communicate sonic frequencies to a given location on the occupant.

4. The furniture of claim 2, wherein the furniture comprises a plurality of internal transducers, each internal transducer located in one of a plurality of distinct zones extending along a length of the mattress from the head end surface to the foot end surface, each zone extending partially along the length and corresponding to a given body portion of the occupant.

5. The furniture of claim 4, wherein the distinct zones align with given body portions of a desired percentage of a population of occupants.

6. The furniture of claim 5, wherein the desired percentage is at least ninety five percent.

7. The furniture of claim 2, wherein each external transducer is disposed in the mattress and extends through the head end surface or one of the opposing side surfaces to communicate sonic frequencies outward from the head end surface or outward from one of the opposing side surfaces adjacent the head end surface.

8. The furniture of claim 2, wherein:

the furniture further comprises a foundation comprising a support surface and a plurality of vertical sides extending down from the support surface, the mattress disposed on the support surface; and each external transducer is disposed in the foundation and extends through one of the vertical sides to communicate sonic frequencies outward from the vertical sides.

9. The furniture of claim 1, wherein the control system comprises a crossover circuit to filter the given sonic signal into the sonic frequency bands.

10. The furniture of claim 1, wherein the control system filters the sonic signal into two frequency bands, a low sonic frequency band and a high sonic frequency band.

11. The furniture of claim 10, wherein the low sonic frequency band comprises frequencies less than 2000 Hz and the high sonic frequency band comprises frequencies greater than 2000 Hz.

12. The furniture of claim 11, wherein the low sonic frequency band comprises from about 20 Hz to about 200 Hz, and the high sonic frequency band comprises from about 2000 Hz to about 20,000 Hz.

13. The furniture of claim 1, wherein the control system filters the sonic signal into three frequency bands, a low sonic frequency band, a middle sonic frequency band and a high sonic frequency band, the low sonic frequency band and the middle sonic frequency band communicated to internal transducers.

14. Furniture for delivering audible and tactile sensations to an occupant, the furniture comprising:

a mattress comprising:

a top surface for supporting the occupant;

a bottom surface opposite the top surface;

a head end surface spanning from the top surface to the bottom surface;

a foot end surface spanning from the top surface to the bottom surface; and two opposing side surfaces spanning from the top surface to the bottom surface, each opposing side surface extending from the head end to the foot end;

at least one internal transducer disposed in the furniture between the top surface and the bottom surface and spaced from the head end surface, the foot end surface and the two opposing side surfaces to communicate sonic frequencies through the furniture to the top surface;

at least one external transducer positioned to communicate sonic frequencies externally to the top surface adjacent the head end surface; and a control system in communication with each internal transducer and each external transducer, the control system configured to receive a given sonic signal, filter the given sonic signal into a low sonic frequency band and a high sonic frequency band, communicate the high sonic frequency band to the external transducers and communicate the low sonic frequency band to the internal transducers.

15. The furniture of claim 14, wherein the low sonic frequency band and the high sonic frequency band comprise distinct sonic frequency bands.

16. The furniture of claim 14, wherein the low sonic frequency band comprises frequencies less than 2000 Hz and the high sonic frequency band comprises frequencies greater than 2000 Hz.

17. The furniture of claim 16, wherein the low sonic frequency band comprises from about 20 Hz to about 200 Hz, and the high sonic frequency band comprises from about 2000 Hz to about 20,000 Hz.

18. The furniture of claim 14, wherein each external transducer is disposed in the mattress and extends through the head end surface or one of the opposing side surfaces to communicate sonic frequencies outward from the head end surface or outward from one of the opposing side surfaces.

19. The furniture of claim 14, wherein:

the furniture further comprises a foundation comprising a support surface and a plurality of vertical sides extending down from the support surface, the mattress disposed on the support surface; and each external transducer is disposed in the foundation and extends through one of the vertical sides to communicate sonic frequencies outward from the vertical sides adjacent the head end surface.

20. The furniture of claim 14, wherein the furniture comprises a plurality of internal transducers, each internal transducer located in one of a plurality of distinct zones extending along a length of the mattress from the head end surface to the foot end surface, each zone extending partially along the length and corresponding to a given body portion of the occupant and the distinct zones aligning with given body portions of at least ninety five percent of a population of occupants.

* * * * *